US009302471B2

(12) United States Patent
Kobayashi et al.

(10) Patent No.: US 9,302,471 B2
(45) Date of Patent: Apr. 5, 2016

(54) LIQUID DROPLET DISCHARGING METHOD AND LIQUID DROPLET DISCHARGING APPARATUS

(71) Applicant: Seiko Epson Corporation, Tokyo (JP)

(72) Inventors: Ayako Kobayashi, Okaya (JP); Jun Hoshii, Shiojiri (JP); Takashi Doi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/805,817

(22) Filed: Jul. 22, 2015

(65) Prior Publication Data

US 2016/0031208 A1 Feb. 4, 2016

(30) Foreign Application Priority Data

Jul. 30, 2014 (JP) ..... 2014-154608

(51) Int. Cl.
*B41J 2/045* (2006.01)
*B41J 2/15* (2006.01)

(52) U.S. Cl.
CPC ..... *B41J 2/04536* (2013.01); *B41J 2/04586* (2013.01)

(58) Field of Classification Search
CPC ..... B41J 29/393; B41J 19/145; B41J 2/2132; B41J 2/155; B41J 2/2135; B41J 2/2146; B41J 2/04505; B41J 2/04545
See application file for complete search history.

(56) References Cited

U.S. PATENT DOCUMENTS

| | | | | |
|---|---|---|---|---|
| 5,621,440 | A | 4/1997 | Takahashi | |
| 6,020,976 | A | 2/2000 | Fujita et al. | |
| 2005/0062784 | A1 | 3/2005 | Matsuzaki et al. | |
| 2009/0015616 | A1 * | 1/2009 | Miyamoto | B41J 2/2139 347/14 |

FOREIGN PATENT DOCUMENTS

| | | |
|---|---|---|
| JP | 02-301447 | 12/1990 |
| JP | 10-044519 | 2/1998 |
| JP | 2005-053167 | 3/2005 |
| JP | 2009-143135 | 7/2009 |
| JP | 2012-187859 | 10/2012 |

* cited by examiner

*Primary Examiner* — Thinh Nguyen

(57) ABSTRACT

Provided is a liquid droplet discharging method including: based on a first correction quantity table correlating to discharging of the first nozzle row, a second correction quantity table correlating to discharging of the second nozzle row, a relative usage ratio of the first nozzle row to the second nozzle row (=a usage rate of the first nozzle row/a usage rate of the second nozzle row), and a third correction quantity table correlating to discharging of a predetermined value Hk which is the relative usage ratio, correcting a liquid droplet quantity, per a unit area in print media, discharged from the first nozzle row and/or the second nozzle row.

20 Claims, 21 Drawing Sheets

FIG. 12

41A 41B

| INK | FIRST NOZZLE GROUP | | | SECOND NOZZLE GROUP | | |
|---|---|---|---|---|---|---|
| | SMALL DOT | MEDIUM DOT | LARGE DOT | SMALL DOT | MEDIUM DOT | LARGE DOT |
| C | 101 | 106 | 97 | 100 | 99 | 96 |
| M | 95 | 98 | 97 | 105 | 101 | 102 |
| Y | 105 | 95 | 97 | 101 | 102 | 100 |
| K | 110 | 108 | 105 | 99 | 109 | 98 |
| LC | 102 | 102 | 105 | 97 | 98 | 102 |
| LM | 96 | 96 | 101 | 102 | 97 | 96 |
| LK | 93 | 101 | 93 | 101 | 100 | 93 |
| LLK | 97 | 102 | 95 | 93 | 101 | 94 |

| HEAD CORRECTION VALUE (ONE COLOR) | SMALL DOT | MEDIUM DOT | LARGE DOT |
|---|---|---|---|
| | 110 | 108 | 96 |

FIG. 18

FIRST CORRECTION QUANTITY TABLE

| INPUT GRADATION VALUE | OUTPUT GRADATION VALUE |
|---|---|
| 0 | 0 |
| 1 | 0.98 |
| 2 | 1.98 |
| 3 | 2.96 |
| 4 | 3.95 |
| 5 | 4.84 |
| 6 | 5.92 |
| ⋮ | |
| 120 | 100.00 |
| ⋮ | |
| 252 | 251.90 |
| 253 | 252.95 |
| 254 | 253.97 |
| 255 | 255 |

SECOND CORRECTION QUANTITY TABLE

| INPUT GRADATION VALUE | OUTPUT GRADATION VALUE |
|---|---|
| 0 | 0 |
| 1 | 1.02 |
| 2 | 2.02 |
| 3 | 3.03 |
| 4 | 4.05 |
| 5 | 5.06 |
| 6 | 6.07 |
| ⋮ | |
| 120 | 150 |
| ⋮ | |
| 252 | 252.02 |
| 253 | 253.01 |
| 254 | 254.01 |
| 255 | 255 |

FIG. 19

THIRD CORRECTION QUANTITY TABLE

| INPUT GRADATION VALUE | OUTPUT GRADATION VALUE |
|---|---|
| 0 | 0 |
| 1 | 1.00 |
| 2 | 2.01 |
| 3 | 3.02 |
| 4 | 4.03 |
| 5 | 5.05 |
| 6 | 6.06 |
| ⋮ | |
| 120 | 128 |
| ⋮ | |
| 252 | 252.01 |
| 253 | 253.01 |
| 254 | 253.01 |
| 255 | 255 |

LIQUID DROPLET DISCHARGING METHOD AND LIQUID DROPLET DISCHARGING APPARATUS

BACKGROUND

1. Technical Field

The present invention relates to a liquid droplet discharging method and a liquid droplet discharging apparatus.

2. Related Art

As a liquid droplet discharging apparatus of the related art, an ink jet printer is known in which liquid droplets (ink droplets) are discharged to a surface of print media to cause an image to be formed thereon. The ink jet printer includes a transport action where print media such as a paper or cloth is moved in a transporting direction, and a dot-forming action where a head in which a plurality of nozzles is formed is scan-moved in a scanning direction intersecting the transporting direction of the print media to cause ink droplets to be discharged from each nozzle. In the ink jet printer, the transport action and the dot-forming action are alternately repeated so as to cause rows of dots (dot rows), lined up in the scanning direction, to be formed in parallel in the transporting direction and thus an image is formed on the print media. In such an ink jet printer, in order to form a further highly refined image at high speed, a plurality of heads in which further minutely precise nozzles are arranged at high density is used.

In a case where a plurality of heads is used, there is a probability that the differences in ink discharging characteristics between each head causes color irregularity to be generated. As a technique for improving handling of the color irregularity, JP-A-2009-143135 proposes a method in which a correction result based on a correction value of ink discharging characteristics of each head is weighted according to a usage rate of the head for each dot row and thus the ink discharging quantity is corrected.

In the correction method described in JP-A-2009-143135, however, there is a problem in that in a case where there is a relative positional shift of a dot between a plurality of heads, it is difficult to appropriately correct the shift. Specifically, there is a problem in that, even in a case where a correction for each single head or a weighting correction according to a usage rate of the nozzles is appropriately performed, the relative positional shift of the dot causes the shift from the original color to be generated in an area where printing is performed by the plurality of heads. As a result, there is a problem in that the difference in colors is generated between an area where printing is performed by a single head and an area where printing is performed by the plurality of heads.

SUMMARY

An advantage of some aspects of the invention is to provide a solution for solving at least a part of the problems described above, and the invention can be realized in the following application examples or the forms.

APPLICATION EXAMPLE 1

According to this application example, there is provided a liquid droplet discharging method which includes a transport action where print media is moved in a transporting direction, and a liquid droplet discharging action where a first nozzle row and a second nozzle row in which a plurality of nozzles is lined up in the transporting direction are caused to be scan-moved in a scanning direction intersecting the transporting direction and the liquid droplet is caused to be discharged to the print media from the nozzle, in which the transport action and the liquid droplet discharging action are alternately repeated so as to cause a plurality of dot rows, which is configured to include dots lined up in the scanning direction, to be formed in the transporting direction, the method including: based on a first correction quantity table correlating to discharging of the first nozzle row, a second correction quantity table correlating to discharging of the second nozzle row, a relative usage ratio of the first nozzle row to the second nozzle row (=a usage rate of the first nozzle row/a usage rate of the second nozzle row), and a third correction quantity table correlating to discharging of a predetermined value Hk which is the relative usage ratio, correcting a liquid droplet quantity, per a unit area in print media, discharged from the first nozzle row and/or the second nozzle row in order to form the dot row.

The liquid droplet discharging method according to the application example includes the transport action where print media is moved in the transporting direction, and the liquid droplet discharging action where the first nozzle row and the second nozzle row in which the plurality of nozzles is lined up in the transporting direction are caused to be scan-moved in the scanning direction intersecting the transporting direction and the liquid droplet is discharged to the print media from the nozzle. Further, in the liquid droplet discharging method according to the application example, the transport action and the liquid droplet discharging action are alternately repeated so as to cause a plurality of dot rows, which is configured to include dots lined up in the scanning direction, to be formed in the transporting direction.

According to the application example, based on the first correction quantity table correlating to discharging of the first nozzle row, the second correction quantity table correlating to discharging of the second nozzle row, the relative usage ratio of the first nozzle row to the second nozzle row (=a usage rate of the first nozzle row/a usage rate of the second nozzle row), and the third correction quantity table correlating to discharging of the predetermined value Hk which is the relative usage ratio, a liquid droplet quantity, per a unit area in print media, discharged from the first nozzle row and/or the second nozzle row in order to form the dot row is corrected.

The first correction quantity table corresponds to a correction quantity table in which a liquid droplet quantity, per a unit area in print media, discharged from the nozzle of the first nozzle row is corrected. In other words, if based on the first correction quantity table, it is possible to correct discharging of the liquid droplet from the nozzle of the first nozzle row according to liquid droplet discharging characteristics of the nozzle of the first nozzle row.

The second correction quantity table corresponds to a correction quantity table in which a liquid droplet quantity, per a unit area in print media, discharged from the nozzle of the second nozzle row is corrected. In other words, if based on the second correction quantity table, it is possible to correct discharging of the liquid droplet from the nozzle of the second nozzle row according to liquid droplet discharging characteristics of the nozzle of the second nozzle row.

The third correction quantity table corresponds to the correction quantity table in which a liquid droplet quantity, per a unit area in print media, discharged from the nozzles of the first nozzle row and the second nozzle row is corrected. In other words, if based on the third correction quantity table, it is possible to correct discharging of the liquid droplet from the nozzles of the first nozzle row and the second nozzle row according to liquid droplet discharging characteristics of the nozzle of the first nozzle row and liquid droplet discharging characteristics of the nozzle of the second nozzle row, the liquid droplet discharging characteristics including relative positional shifts of dots between dots formed by the first nozzle row and dots formed by the second nozzle row.

According to the liquid droplet discharging method of the application example, based on the first correction quantity table, the second correction quantity table, the third correction quantity table, and the relative usage ratio of the first nozzle row to the second nozzle row, the liquid droplet quantity discharged from the first nozzle row and/or the second nozzle row, that is, the liquid droplet quantity, per a unit area in print media, discharged from the nozzle in order to form the dot row is corrected. Therefore, according to the application example, it is possible to appropriately and respectively correct an area which is configured to include dot rows formed by discharging of the first nozzle row, an area which is configured to include dot rows formed by discharging of the second nozzle row, and an area which is configured to include dot rows formed by discharging of the first nozzle row and the second nozzle row, and the occurrence of difference between each area is suppressed when each area is corrected. Therefore, it is possible to perform more excellent printing.

APPLICATION EXAMPLE 2

In the liquid droplet discharging method according to the application example, the predetermined value Hk may be 1.

Further, according to the application example, the predetermined value Hk is 1. In other words, since the usage rate of the first nozzle row and the usage rate of the second nozzle row are identical to each other, it is possible to further efficiently perform printing in the method in which the first nozzle row and the second nozzle row is used to perform printing.

APPLICATION EXAMPLE 3

In the liquid droplet discharging method according to the application example, in a case where the relative usage ratio>the predetermined value Hk is established, based on the first correction quantity table, the third correction quantity table and the relative usage ratio, the liquid droplet quantity discharged from the first nozzle row and/or the second nozzle row may be corrected, and in a case where the relative usage ratio<the predetermined value Hk is established, based on the second correction quantity table, the third correction quantity table and the relative usage ratio, the liquid droplet quantity, per a unit area in print media, discharged from the first nozzle row and/or the second nozzle row in order to form the dot row may be corrected.

Further, according to the application example, in a case where the relative usage ratio>the predetermined value Hk is established, that is, in a case where the usage rate of the first nozzle row is greater than the usage rate of the second nozzle row, based on the first correction quantity table, the third correction quantity table, and the relative usage ratio, the liquid droplet quantity, discharged from the first nozzle row and/or the second nozzle row is corrected. Further, in a case where the relative usage ratio<the predetermined value Hk, that is, in a case where the usage rate of the second nozzle row is greater than the usage rate of the first nozzle row, based on the second correction quantity table, the third correction quantity table and the relative usage ratio, the liquid droplet quantity, per a unit area in print media, discharged from the first nozzle row and/or the second nozzle row in order to form the dot row is corrected. Since the correction is performed according to the correction quantity table correlating to the nozzle row having greater influence, it is possible to further appropriately perform the correction.

APPLICATION EXAMPLE 4

According to this application example, there is provided a liquid droplet discharging apparatus including: a transport section that moves print media in a transporting direction; a first nozzle row and a second nozzle row in which a plurality of nozzles discharging liquid droplets to the print media is lined up in the transporting direction; a scan moving section that causes the first nozzle row and the second nozzle row to be scan-moved in a scanning direction intersecting the transporting direction; and a control section that performs drive-control of the transport section and the scan moving section and performs discharge-control of the liquid droplet discharged from the nozzle so as to cause a plurality of dot rows, which is configured to include dots lined up in the scanning direction, to be formed in the transporting direction, in which, based on a first correction quantity table correlating to discharging of the first nozzle row, a second correction quantity table correlating to discharging of the second nozzle row, a relative usage ratio of the first nozzle row to the second nozzle row (=a usage rate of the first nozzle row/a usage rate of the second nozzle row), and a third correction quantity table correlating to discharging of a predetermined value Hk which is the relative usage ratio, a liquid droplet quantity, per a unit area in print media, discharged from the first nozzle row and/or the second nozzle row in order to form the dot row is corrected.

Further, according to the application example, the liquid droplet discharging apparatus includes the transport section that moves print media in the transporting direction, the first nozzle row and the second nozzle row in which the plurality of nozzles discharging the liquid droplet to the print media is lined up in the transporting direction, the scan moving section that causes the first nozzle row and the second nozzle row to be scan-moved in the scanning direction intersecting the transporting direction, and the control section that performs drive-controlling of the transport section and the scan moving section and performs discharge-control of the liquid droplet discharged from the nozzle so as to cause a plurality of dot rows, which is configured to include dots lined up in the scanning direction, to be formed in the transporting direction. Further, based on the first correction quantity table correlating to discharging of the first nozzle row, the second correction quantity table correlating to discharging of the second nozzle row, the relative usage ratio of the first nozzle row to the second nozzle row (=a usage rate of the first nozzle row/a usage rate of the second nozzle row), and the third correction quantity table correlating to discharging of the predetermined value Hk which is the relative usage ratio, a liquid droplet quantity, per a unit area in print media, discharged from the first nozzle row and/or the second nozzle row in order to form the dot row is corrected.

Therefore, according to the application example, it is possible to appropriately and respectively correct an area which is configured to include dot rows formed by discharging of the first nozzle row, an area which is configured to include dot rows formed by discharging of the second nozzle row, and an area which is configured to include dot rows formed by discharging of the first nozzle row and the second nozzle row, and occurrence of difference between each area is suppressed when each area is corrected. Therefore, it is possible to perform further excellent printing.

BRIEF DESCRIPTION OF THE DRAWINGS

The invention will be described with reference to the accompanying drawings, wherein like numbers reference like elements.

FIG. 12 is an explanatory diagram showing correction values of color irregularity.

FIG. 18 is an explanatory diagram showing examples of a first correction quantity table and a second correction quantity table.

FIG. 19 is an explanatory diagram showing an example of a third correction quantity table.

DESCRIPTION OF EXEMPLARY EMBODIMENTS

Hereinafter, embodiments implementing aspects of the invention will be described with reference to the drawings. The descriptions provided below are of one embodiment of the invention, and are not intended to limit the invention. Further, for easy understanding of explanation, there may be a case where elements shown in each drawing have a dimensional scale different from the actual dimensional scale.

First Embodiment

Figure 1:
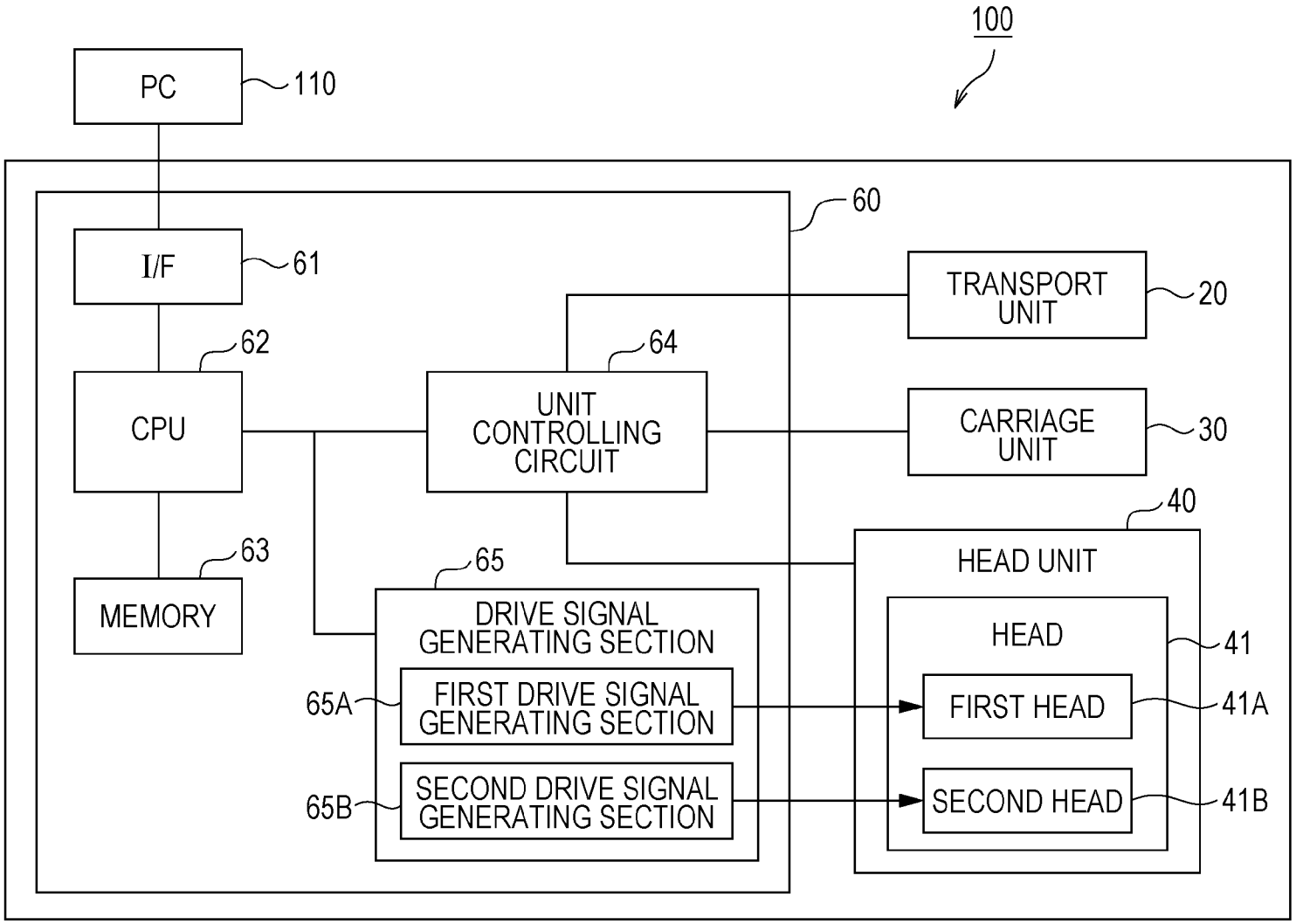
FIG. 1 is a block diagram showing an entire configuration of an ink jet printer as a liquid droplet discharging apparatus according to a first embodiment.
Figure 2:
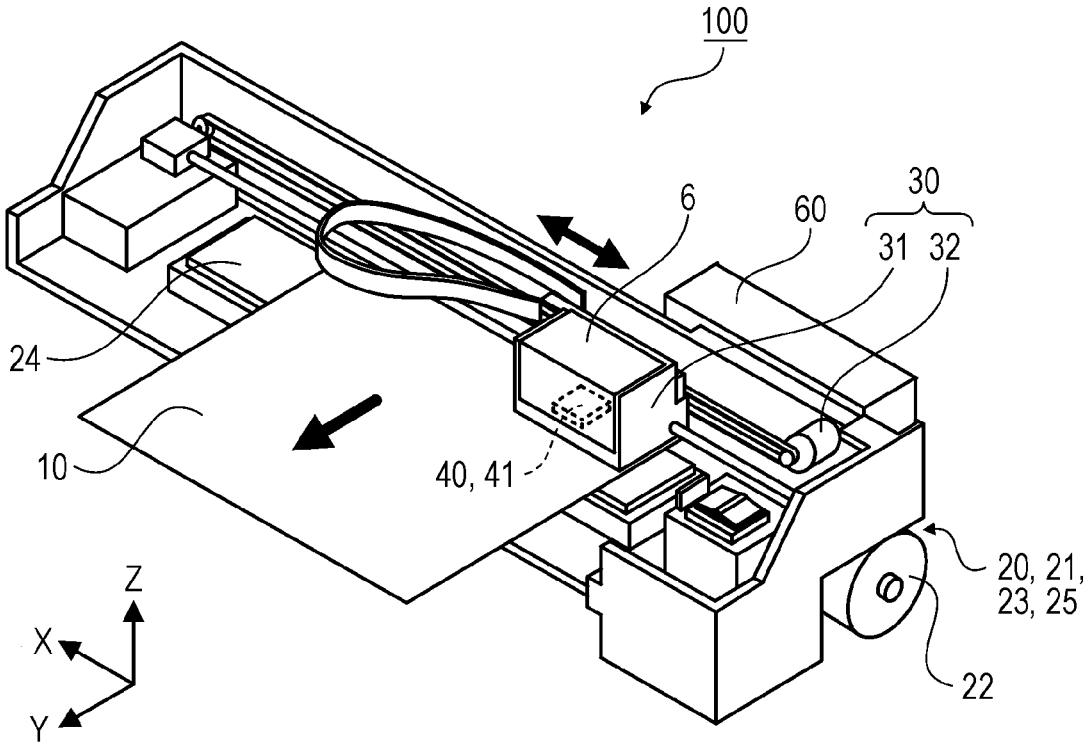
FIG. 2 is a perspective view showing the ink jet printer as the liquid droplet discharging apparatus according to the first embodiment.

FIG. 1 is a block diagram showing an entire configuration of an ink jet printer 100 as "a liquid droplet discharging apparatus" according to a first embodiment, and FIG. 2 is a perspective view of the ink jet printer 100.

Further, In the XYZ axes shown in the drawings, the ink jet printer 100 is provided in the X-Y plane. Further, a ±X direction (the X axis direction) is assumed to be a scanning direction to be described later, a Y direction is assumed to be a transporting direction to be described later, and a Z direction is assumed to be a height direction, in the following description.

Firstly, a basic configuration of the ink jet printer 100 will be described.

Basic Configuration of Ink Jet Printer

The ink jet printer 100 includes a transport unit 20 as "a transport section", a carriage unit 30 as "a scan moving section", a head unit 40 and a controller 60 as "a control section". The ink jet printer 100 receives print data from a personal computer 110 as an external apparatus (a computer which a user uses, hereinafter, referred to as a PC 110), and then the ink jet printer 100 uses the controller 60 to control each unit (the transport unit 20, the carriage unit 30 and the head unit 40). Based on the print data received from the PC 110, the controller 60 controls each unit, and causes an image to be printed (image-forming) on a paper 10 as print media.

The print data corresponds to data for the image-forming. For example, a general image processing application software (hereinafter, referred to as an application) and a printer driver software (hereinafter, referred to as a printer driver) which are installed in the PC 110 are used to perform conversion processing with respect to, for example, general RGB digital image information acquired by, for example, a digital camera and the like, and to thereby generate the data for the image-forming which is capable of being printed in the ink jet printer 100.

The transport unit 20 causes the paper 10 to be moved in a predetermined transporting direction (the Y direction shown in FIG. 2). The transport unit 20 includes a paper feeding roller 21, a transport motor 22, a transport roller 23, a platen 24, a paper discharging roller 25 and the like. The paper feeding roller 21 feeds paper 10 inserted into a paper inserting port to the internal portion of the ink jet printer 100. The transport roller 23 transports the paper 10 fed by the paper feeding roller 21 up to a printable area, and is driven by the transport motor 22. The platen 24 supports the paper 10 which is under printing. The paper discharging roller 25 discharges the paper 10 to the outside of the printer, and is provided downstream in the transporting direction with respect to the printable area.

The carriage unit 30 causes heads 41 (to be described later) to be moved (scanned) in a predetermined moving direction (the X axis direction shown in FIG. 2, hereinafter referred to as a scanning direction). The carriage unit 30 includes a carriage 31, a carriage motor 32 and the like. The carriage 31 is capable of reciprocally moving in the scanning direction, and is driven by the carriage motor 32. Further, the carriage 31 detachably retains an ink cartridge 6 that accommodates ink.

The head unit 40 discharges ink as "a liquid droplet" (hereinafter referred to as an ink droplet) to the paper 10. The head unit 40 includes a head 41 which is provided with a plurality of nozzles. The head 41 is mounted in the carriage 31. Therefore, if the carriage 31 moves in the scanning direction, the head 41 also moves in the scanning direction. While moving in the scanning direction, the head 41 intermittently discharges ink and thus a dot row which is configured to include dots (hereinafter referred to as a raster line) lined up in the scanning direction is formed on the paper 10.

Further, the head 41 includes two heads (a first nozzle group 41A and a second nozzle group 41B). The configuration of the head 41 will be described later.

The controller 60 is a control section that performs controlling of the ink jet printer 100. The controller 60 includes an interface section 61, a CPU 62, a memory 63, a unit controlling circuit 64 and the like. The interface section 61 transmits and receives data between a PC 110 as an external apparatus and the ink jet printer 100. The CPU 62 is a computation processing device that performs controlling of the entire printer. The memory 63 provides an area storing programs of the CPU 62, or a working area, and includes memory elements such as a RAM, an EEPROM and the like.

According to programs stored in the memory 63, the CPU 62 controls each unit (the transport unit 20, the carriage unit 30 and the head unit 40) through a unit controlling circuit 64.

Further, the controller 60 is provided with a drive signal generating section 65. The drive signal generating section 65 includes a first drive signal generating section 65A and a second drive signal generating section 65B. The first drive signal generating section 65A generates a first drive signal that drives a piezoelectric element of the first nozzle group 41A. The second drive signal generating section 65B generates a second drive signal that drives a piezoelectric element of the second nozzle group 41B. When dots are formed in the form of odd numbered dots (to be described later), each drive signal generating section generates a drive signal for the odd numbered dots, and when dots are formed in the form of even numbered dots (to be described later), each drive signal generating section generates a drive signal for the even numbered dots. Each of the drive signal generating sections is provided independently from each other. For example, when the first drive signal generating section 65A generates the drive signal for the odd numbered dots, the second drive signal generating section 65B may generate the drive signal for the odd numbered dots or the drive signal for the even numbered dots.

When printing is performed, the controller 60 alternately and repeatedly performs "a liquid droplet discharging action" which causes ink as liquid droplets to be discharged from a head 41 which is under moving in the scanning direction, and "a transport action" which causes the paper 10 to be moved in the transporting direction, and causes an image, configured to include a plurality of dots, to be printed on the paper 10. Further, the liquid droplet discharging action is referred to as "pass", and an nth-time pass is referred to "pass n".

Configuration of Head

Figure 3:
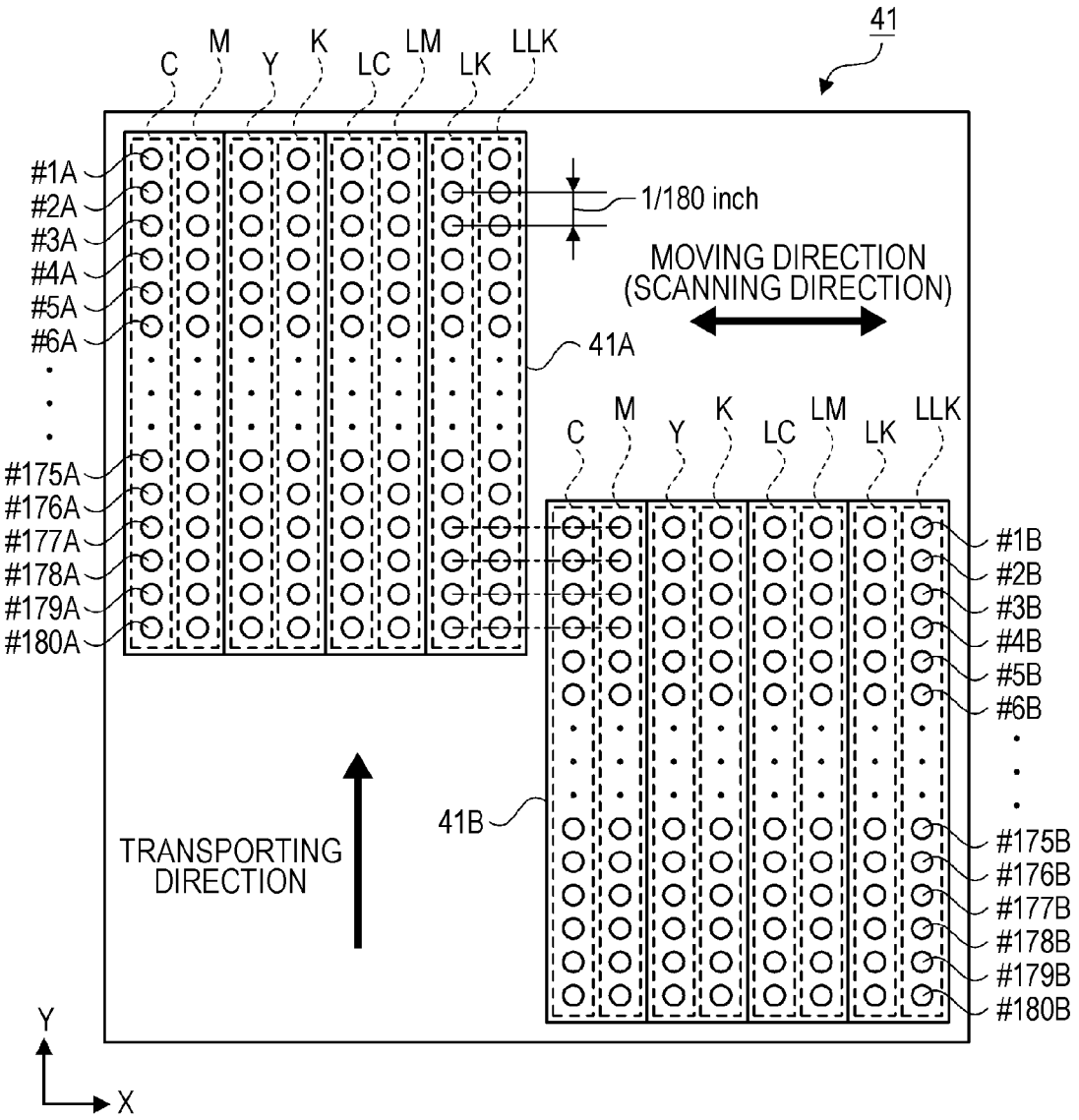
FIG. 3 is an explanatory diagram showing one example of arrangement of nozzles.

FIG. 3 is an explanatory diagram showing one example of arrangement of nozzles, the nozzles being provided in the head 41. The head 41 includes two nozzle groups which correspond to the first nozzle group 41A and the second nozzle group 41B. Each nozzle group is provided with eight nozzle rows and discharging ports of the nozzles are opened in the bottom face of the head 41. The eight nozzle rows discharge, respectively, ink of a dark cyan (C), a dark magenta (M), a yellow (Y), a dark black (K), a light cyan (LC), a light magenta (LM), a light black (LK), and an extremely light black (LLK).

Each nozzle row is provided with 180 nozzles (nozzles #1A to #180A, and nozzles #1B to #180B) which are lined up in the transporting direction at nozzle pitches of 180 dpi. In FIG. 3, the numbers allocated to the nozzles gradually decrease in the order as the nozzles move to the downstream side (+Y side) in transporting direction. Each of the nozzles is provided with a piezoelectric element (not shown) as a driving element that discharges ink droplets from each nozzle.

The first nozzle group 41A is provided farther downstream than the second nozzle group 41B in the transporting direction. The first nozzle group 41A and the second nozzle group 41B are provided so that four nozzles can overlap each other in positions thereof in the transporting direction. For example, the position of nozzle #177A of the first nozzle group 41A in the transporting direction is identical to the position of nozzles #1B of the second nozzle group 41B in the transporting direction. According to this, in a certain liquid droplet discharging action, when nozzle #177A of the first nozzle group 41A is capable of forming dots with respect to a certain pixel, nozzle #1B of the second nozzle group 41B is also capable of forming dots with respect to the certain pixel.

Further, when nozzle rows discharging the same ink (the ink configured of same composition) between the first nozzle group 41A and the second nozzle group 41B are combined, the combination is referred to as "a head set".

Figure 4:
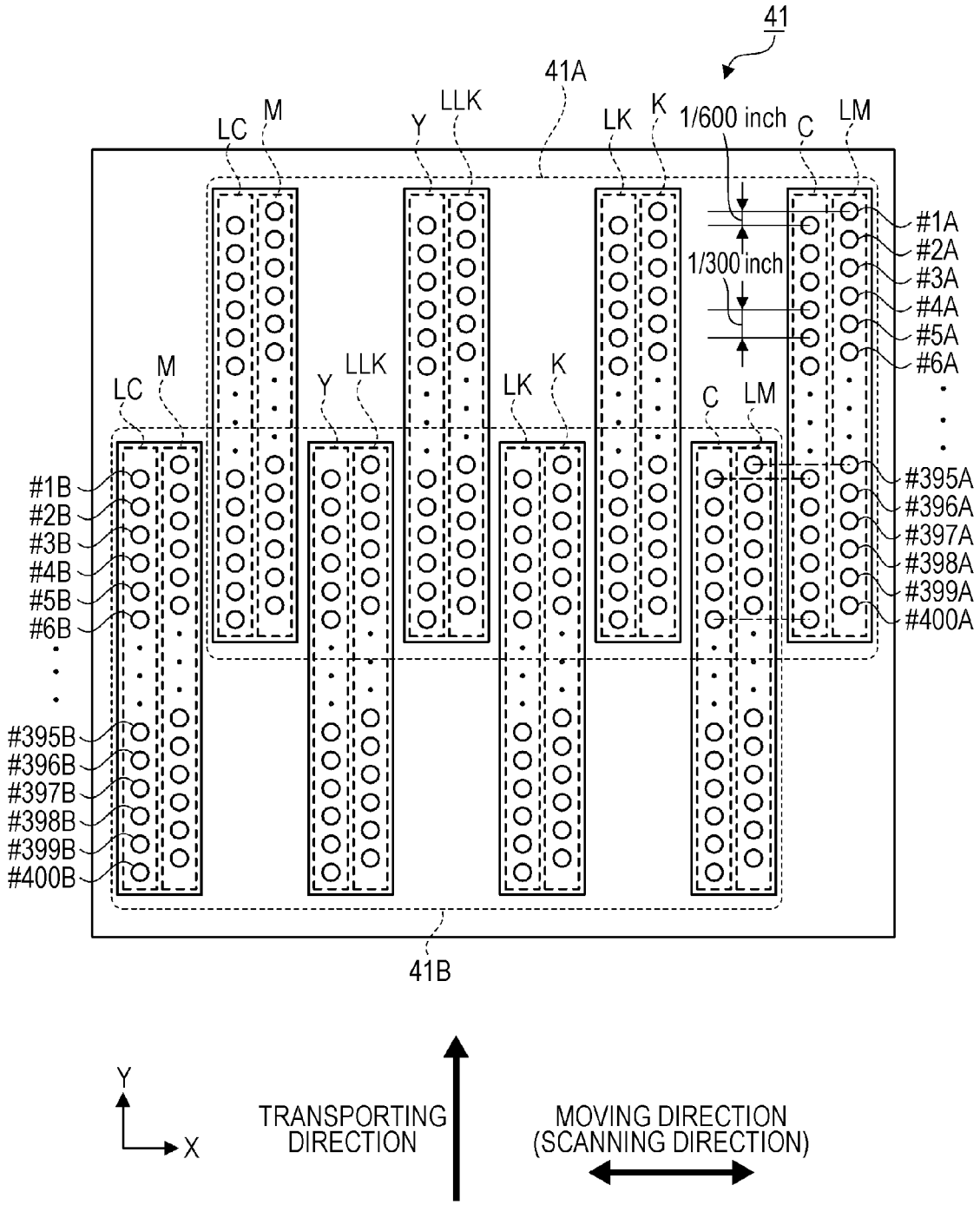
FIG. 4 is an explanatory diagram showing one example of arrangement of nozzles.

FIG. 4 is an explanatory diagram showing one example of arrangement of nozzles, the nozzles being provided in the head 41. In the example shown in FIG. 4, the head sets are disposed further close in positions when compared with those shown in FIG. 3. More specifically, in the example of FIG. 4, the first nozzle group 41A and the second nozzle group 41B are disposed such that one set is formed of two nozzle rows in each group, and each set for each group is alternately disposed in parallel. Further, in each nozzle row, 400 nozzles (nozzles #1A to #400A, and nozzles #1B to #400B) are lined up in the transporting direction and are provided at nozzle pitches of 300 dpi, and in the one set formed of two rows, two rows are disposed to be shifted toward each other by ½ pitch (1/600 inch).

Further, the first nozzle group 41A and the second nozzle group 41B are disposed so that positions of six nozzles for one group overlaps positions of six nozzles for the other group in the transporting direction. For example, the position of nozzle #395A of the first nozzle group 41A in the transporting direction is identical to the position of nozzle #1B of the second nozzle group 41B in the transporting direction. According to this, in a certain liquid droplet discharging action, when the nozzle #395A of the first nozzle group 41A is capable of forming dots with respect to a certain pixel, the nozzle #1B of the second nozzle group 41B is also capable of forming the dots.

Marking Method of Nozzle Rows and Nozzles

Before the dot forming method is described, a marking method of nozzle rows and nozzles will be described.

Figure 5:
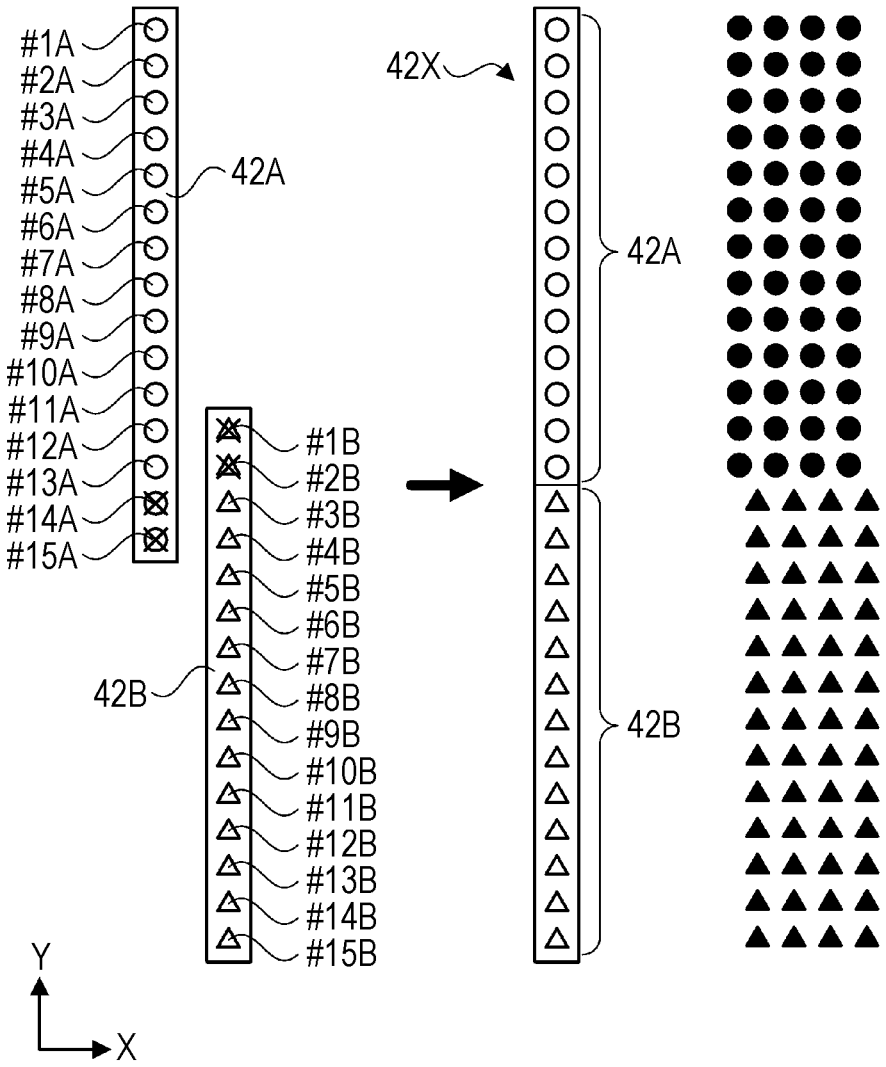
FIG. 5 is an explanatory diagram showing that a head set is marked in the form of a virtual head set.

FIG. 5 is an explanatory diagram showing that a head set is marked in the form of a virtual head set 42X.

In the left portion of FIG. 5, the nozzle row of, for example, dark black in the first nozzle group 41A, and the same nozzle row of dark black in the second nozzle group 41B are illustrated. In the description provided below, the nozzle row of dark black in the first nozzle group 41A is referred to as the first head 42A, and the nozzle row of dark black in the second nozzle group 41B is referred to as the second head 42B. Further, for the sake of simple description, the number of the nozzles in each nozzle row is assumed to be 15. Further, the first head 42A corresponds to "the first nozzle row" according to one aspect of the invention, and the second head 42B corresponds to "the second nozzle row" according to one aspect of the invention.

Regarding positions of nozzles in the transporting direction, four nozzles (nozzle #12A to nozzle #15A) of the first head 42A located upstream in the transporting direction overlap four nozzles (nozzle #1B to nozzle #4B) of the second head 42B located downstream in the transporting direction. In the description provided below, these four nozzles in each nozzle row are referred to as overlapping nozzles.

Each nozzle of the first head 42A is indicated as a circle mark, and each nozzle of the second head 42B is indicated as a triangle mark. Further, nozzles which do not discharge ink (that is, nozzles which do not form dots) are indicated as an X mark.

Herein, among the overlapping nozzles of the first head 42A, nozzle #12A and nozzle #13A discharge ink, and nozzle #14A and nozzle #15A do not discharge ink. Further, among the overlapping nozzles of the second head 42B, nozzle #1B and nozzle #2B do not discharge ink, and nozzle #3B and nozzle #4B discharge ink.

In this case, as described in the central portion of FIG. 5, two heads (the first head 42A and the second head 42B) constituting a head set can be referred to as one virtual head set 42X. In the description provided below, two heads will not be separately referred to. Instead, a description will be made of a state where one virtual head set 42X is used to form dots.

Further, as shown in the right portion of FIG. 5, in the virtual head set 42X, even when the nozzle with the circle mark forms dots in the form of the odd numbered dots (to be described later), the nozzle with the triangle mark can form dots in the form of the even numbered dots (to be described later). Of course, when the nozzle with the circle mark forms dots in the form of the odd numbered dots, the nozzle with the triangle mark is also capable of forming dots in the form of the odd numbered dots.

Further, the operation in which ink droplets are discharged from individual nozzles to form dots is performed according to the print data received by the controller 60. However, herein, for the sake of simple description, discharging or non-discharging based on the individual print data will not be described. In other words, based on a state where the dots are formed with respect to all of the positions at which the correlated nozzles can discharge ink droplets based on the print data, a description will be made.

Dot Forming Method Based on Normal Processing

Figure 6:
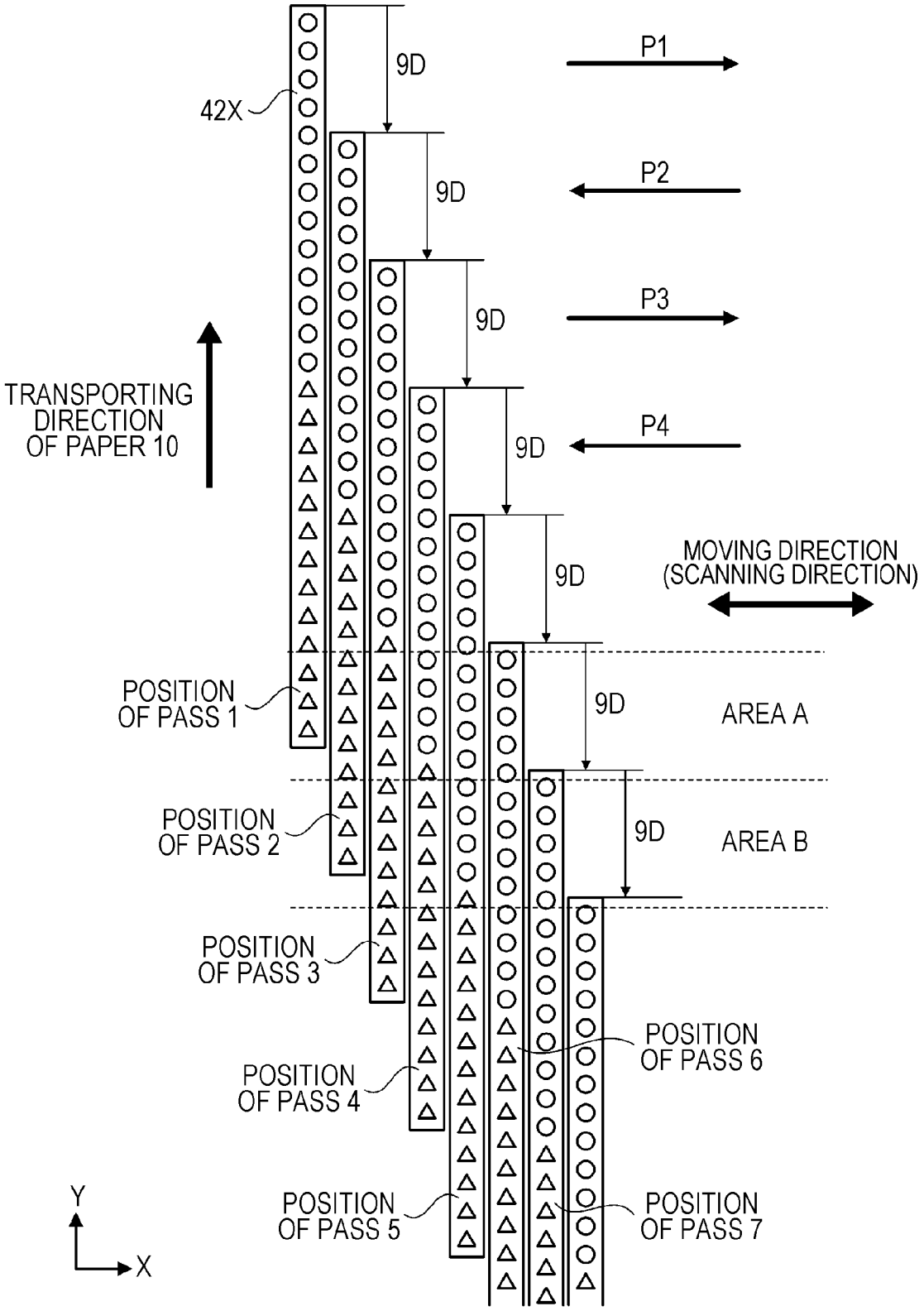
FIG. 6 is an explanatory diagram showing an example of normal processing.

FIG. 6 is an explanatory diagram showing an example of normal processing. The normal processing corresponds to a process (the liquid droplet discharging action and the transport action) which is performed when printing is performed in the central portion of the paper 10 (an area except for the upper end portion and the lower end portion in the paper 10). The controller 60 controls each unit to thereby cause the normal processing described below to be performed.

In FIG. 6, a step reflecting each transport quantity 9D of the paper 10 transported by the transport unit 20 has a relative position based on moving of the step, and the relative positions are shown in the slope direction so as to cause the virtual head set 42X not to be overlapped with each other. In other words, FIG. 6 shows that the virtual head set 42X is moved with respect to the paper 10. However, actually, the paper 10 is moved in the transporting direction. In FIG. 6, the positional relationship of the virtual head set 42X in the X direction is meaningless. Further, arrow marks P1 to P4 indicate a direction in which the virtual head set 42X is scan-moved in the scanning direction (the X axis direction).

As for the normal processing, in the transport action which is performed between a pass and a pass, the paper 10 is transported at a transport quantity 9D of nine dots. For example, FIG. 6 shows that pass 1 to pass 6 causes dots to be formed in area A in FIG. 6 (the area on the paper 10), and pass 2 to pass 7 causes dots to be formed in area B.

In an odd numbered pass, each nozzle is located at, for example, an odd numbered raster line (a dot row extending in the scanning direction). After the odd numbered pass, the paper 10 is transported as much as a transport quantity 9D of nine dots, and then an even numbered pass is performed. Therefore, in the even numbered pass, each nozzle is located at an even numbered raster line. As such, a position of each nozzle is alternately located at an odd numbered raster line or an even numbered raster line for each pass.

Figure 7:
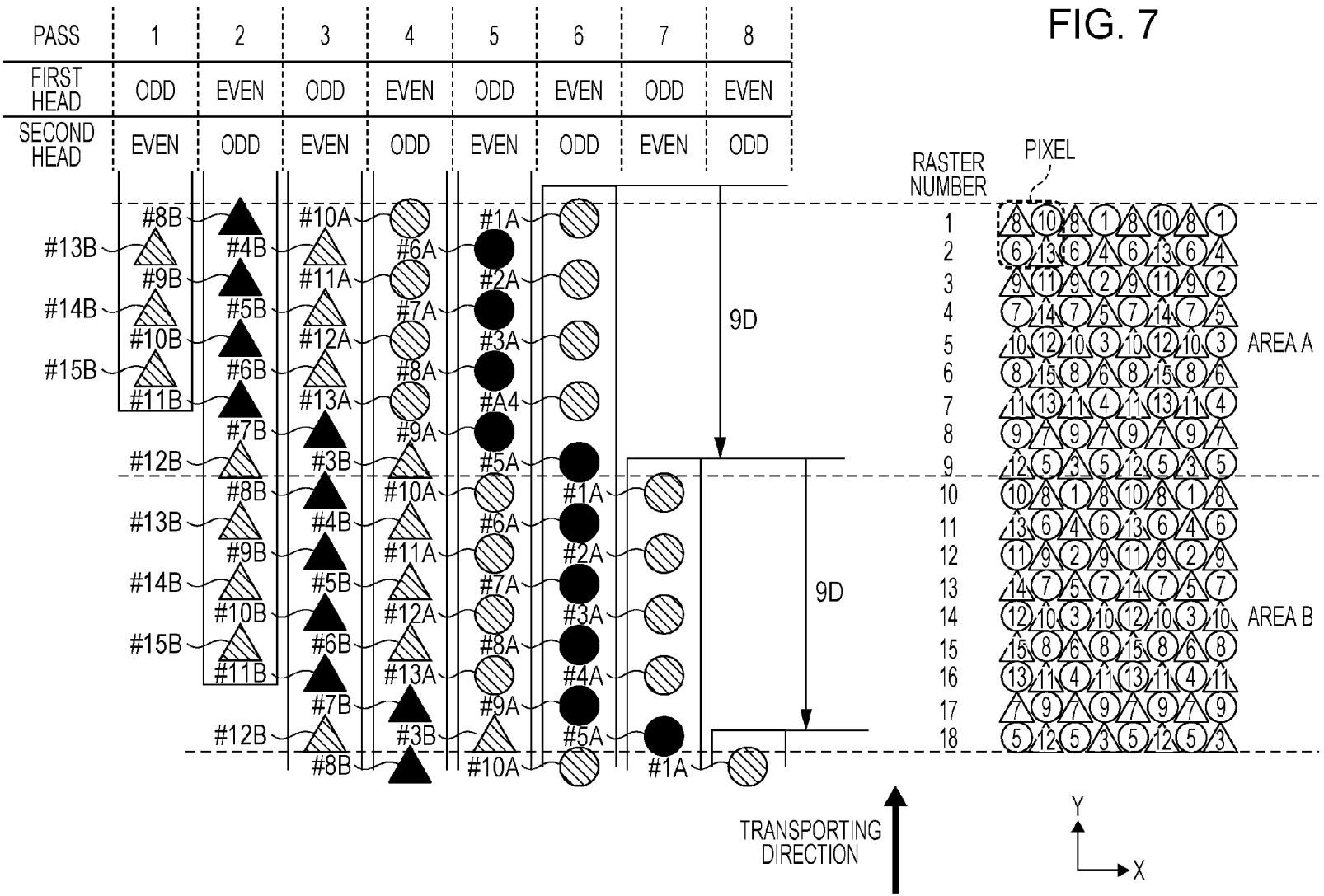
FIG. 7 is an explanatory diagram showing an example of dot-forming in the normal processing.

FIG. 7 is an explanatory diagram showing an example of dot-forming in area A and area B in FIG. 6. Herein, FIG. 7 shows a case where four dots adjacent to each other, for example, in the up and down and right and left portions are used to form one pixel.

In the left portion of FIG. 7, relative positions of the nozzles in each pass are shown. A nozzle with a black mark forms dots at the rate of one dot per pixel during the pass of the nozzle. For example, nozzle #8B of pass 2 forms dots at the rate of one dot per each two-dot position. An oblique-line hatched nozzle forms dots at the rate of one dot per each two pixels. For example, nozzle #10A of pass 4 forms dots at the rate of one dot per each four-dot position.

The oblique-line hatched nozzle forms half as many dots as the nozzle with the black mark. Hereinafter, the oblique-line hatched nozzle is referred to as a POL nozzle. Four nozzles (nozzle #10A to nozzle #13A) of the first head 42A in a certain pass upstream (−Y side) in the transporting direction, and four nozzles (nozzle #1A to nozzle #4A) of the first head 42A downstream (+Y side) in the transporting direction after two-time transport actions from this pass, overlap with each other in the position thereof in the transporting direction. Such a nozzle corresponds to the POL nozzle. For example, nozzle #10A to nozzle #13A in pass 4 and nozzle #1A to nozzle #4A in pass 6 overlap with each other in positions in the transporting direction, and thus the nozzles correspond to the POL nozzles.

Similarly, four nozzles (nozzle #12B to nozzle #15B) of the second head 42B in a certain pass upstream in the transporting direction, and four nozzles (nozzle #3B to nozzle #6B) of the second head 42B downstream in the transporting direction after two-time transport actions from this certain pass, overlap with each other in the position thereof in the transporting direction. Such a nozzle corresponds to the POL nozzle. For example, nozzle #12B to nozzle #15B of pass 2 and nozzle #3B to nozzle #6B of pass 4 overlap with each other in positions in the transporting direction, and thus the nozzles correspond to POL nozzles.

In the right portion of FIG. 7, nozzles that form dots in each pixel are shown. For example, the first-time raster line (a line of which the raster number is 1) is configured to include dots which are formed in the form of the odd numbered dots by nozzle #8B, and dots which are formed in the form of the even numbered dots by nozzle #10A and nozzle #1A. Further, herein, for the sake of simple description, each raster line is configured to include only eight dots.

In the upper and left portions of FIG. 7, positions of dots formed by each head are shown. For example, in pass 1, nozzles of the first head 42A (nozzle #1A to nozzle #13A) form dots in the form of the odd numbered dots, and nozzles of the second head 42B (nozzle #3B to nozzle #15B) form dots in the form of the even numbered dots.

Each raster line is configured to include dots which are formed by two or three nozzles. In other words, two or three nozzles correlate to each raster line. For example, the first-time raster line correlates to nozzle #8B of pass 2, nozzle #10A of pass 4, and nozzle #1A of pass 6. Further, each raster line is configured to include dots which are formed by at least one nozzle of the first head 42A and dots which are formed by at least one nozzle of the second head 42B. In other words, each raster line correlates to at least one nozzle of the first head 42A, and at least one nozzle of the second head 42B.

In a case where only one nozzle correlates to the odd numbered dots or the even numbered dots of a certain raster line, the correlating nozzle forms dots at a rate of one dot per two dots. For example, only one nozzle #8B correlates to the odd numbered dots of the first-time raster line (to which other nozzles do not correlate). For this reason, the nozzle #8B forms dots at a rate of one dot per two dots.

On the other hand, in a case where two nozzles correlate to the odd numbered dots or the even numbered dots of a certain raster line, each of the two nozzles forms dots at a rate of one dot per four dots (the nozzles correspond to the POL nozzles). For example, nozzle #10A and nozzle #1A correlate to the even numbered dots of the first-time raster line. For this reason, each of nozzle #10A and nozzle #1A forms dots in a rate of one dot per four dots (the nozzles correspond to the POL nozzles).

In the normal processing, in a certain pass, a position in which the first head 42A forms a dot (a position in the scanning direction) is different from a position in which the second head 42B forms a dot. Specifically, when the first head 42A forms a dot in the form of the odd numbered dots, the second head 42B forms a dot in the form of the even numbered dots. On the contrary, when the first head 42A forms a dot in the form of the even numbered dots, the second head 42B forms a dot in the form of the odd numbered dots. As described above, the first drive signal generating section 65A and the second drive signal generating section 65B are, independently of each other, capable of forming a drive signal and thus it is possible to form such a dot.

Further, in the normal processing, if a certain pass and the next pass of the certain pass are compared to each other, positions in which each head forms a dot are different from each other. For example, in a certain pass, in a case where the first head 42A forms a dot in the form of the odd numbered dots and the second head 42B forms a dot in the form of the even numbered dots, in the next pass, the first head 42A forms a dot in the form of the even numbered dots, and the second head 42B forms a dot in the form of the odd numbered dots.

As such, the dots are formed, and thus one head causes dots to be formed in a zigzag lattice shape, whereas in order to fill space between the dots of the zigzag lattice shape, the other head causes the dots to be formed in the zigzag lattice shape accordingly. With reference to the right portion of FIG. 7, the circle mark dots formed by the first head 42A have the zigzag lattice shape, and the triangle mark dots formed by the second head 42B also have the zigzag lattice shape. Further, viewed in the order of dot-forming, after the second head 42B forms the dots in the zigzag lattice shape, then in order to fill the space between the formed dots, the first head 42A forms the dots.

In a case where a raster line is formed using the normal processing, the dots in the formed raster line are formed of a half made by the first head 42A and the other half made by the second head 42B. In other words, as for a usage rate of each head when those raster lines are formed, the first head 42A has 50% (a constant), and the second head 42B also has 50% (a constant).

A relative usage ratio of the first nozzle row (the first head 42A) to the second nozzle row (the second head 42B) in the area of the normal processing is "a predetermined value Hk". In this case, the predetermined value Hk is 50%/50%=1.

Pass 1 to pass 6 form dots in area A, and pass 2 to pass 7 form dots in area B, and thus there is a shift corresponding to one-time pass between area A and area B. Since the shift is generated by one-time pass, the nozzle correlating to each raster line is common to each area. However, the positions of the dots formed by each nozzle (the positions in the scanning direction) are different from each other in that the positions formed by each nozzle are exclusively located in the odd numbered dots or the even numbered dots. For example, nozzle #8B of pass 2 forms a dot in the form of the odd numbered dots with respect to the first-time raster line, but nozzle #8B of pass 3 forms a dot in the form of the even numbered dots with respect to a tenth-time raster line.

Further, herein, while not shown, in the 19th-time to 27th-time raster lines which are located farther upstream than area B in the transporting direction, dots are formed by pass 3 to pass 8 approximately similarly to the case of area A. For example, the 19th-time raster line correlates to nozzle #8B, nozzle #10A, and nozzle #1A, and nozzle #8B forms a dot in the form of the odd numbered dots of the 19th-time raster line. Further, in the 28th-time to the 36th-time raster lines which are located upstream further than the 19th-time to the 27th-time raster lines in the transporting direction, dots are formed by pass 4 to pass 9 approximately similar to the case of area B. As such, if the normal processing is continuously performed, dot-forming is repeatedly performed similar to the cases of area A and area B.

In a case where dots are formed in the paper 10 to thereby form, for example, a highly precise image on the paper 10, during a liquid droplet discharging action, the paper 10 is required to be surely retained at a predetermined position (and height), while in the transport action, the paper 10 is required to be accurately moved to a predetermined position. For this reason, the transport unit 20 uses tools or the like that, for example, pinch, push, and attach by suction the paper 10 so as to fix (retain) the paper 10. It is necessary for these retention tools to be configured to avoid interrupting movement of the carriage unit 30, the head unit 40 or the like. In other words, there is provided a configuration in which printing is caused to be surely started or ended in a state where the paper is surely fixed (retained) (in position), and also in the upper end portion or the lower end portion of the paper 10. As a result, for example, as provided in the embodiment, in a configuration in which the first nozzle group 41A and the second nozzle group 41B that have the nozzle rows lined up in the transporting direction (the Y direction) are arranged in parallel in the transporting direction (the Y direction), there is a case where it is difficult to form dots using only the nozzles which are capable of correlating to a head (the first head 42A or the second head 42B) and capable of correlating to each the upper end portion and the lower end portion of the paper 10.

Dot Forming Method Using Upper End Processing

Hereinafter, a description will be made of an example of an upper end processing in a case where a POL-controlled image cannot be formed between a plurality of heads. The upper end processing corresponds to a process (the liquid droplet discharging action and the transport action) which is performed when printing is performed on the upper end area of the paper 10 (the end portion area of +Y side). The controller 60 controls each unit to thereby perform the upper end processing to be described later.

Figure 8A:
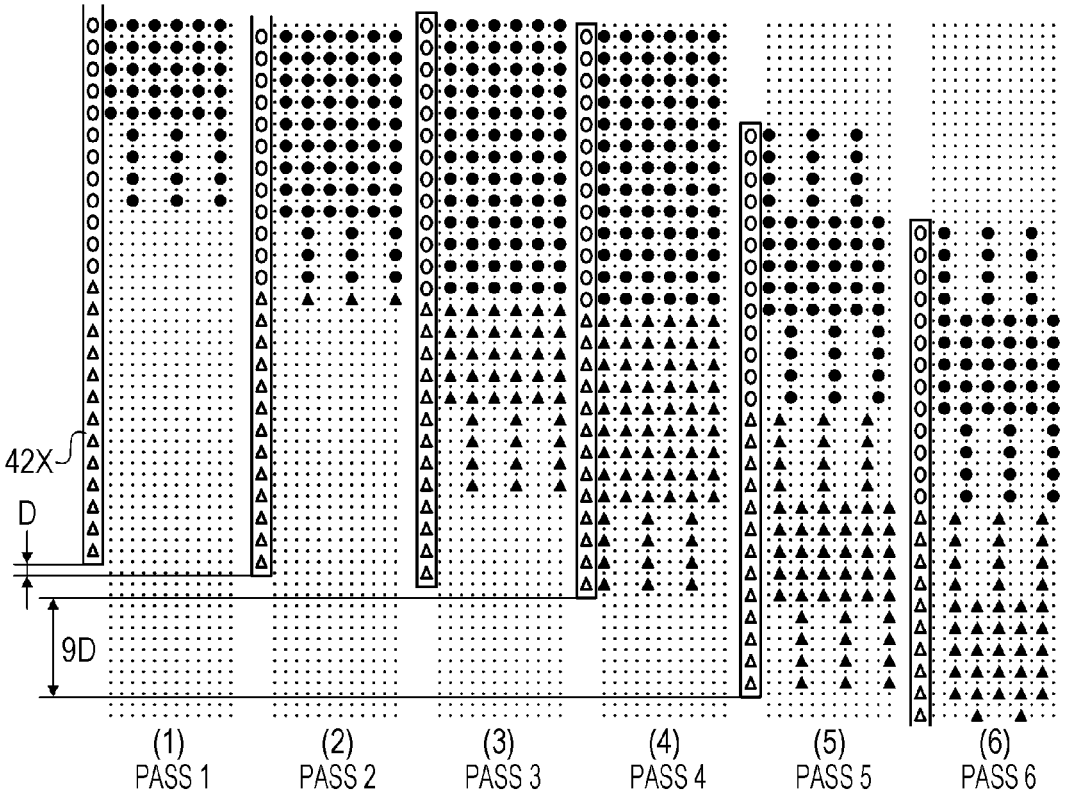
FIG. 8A and FIG. 8B are explanatory diagrams showing an example of upper end processing.
Figure 8B:
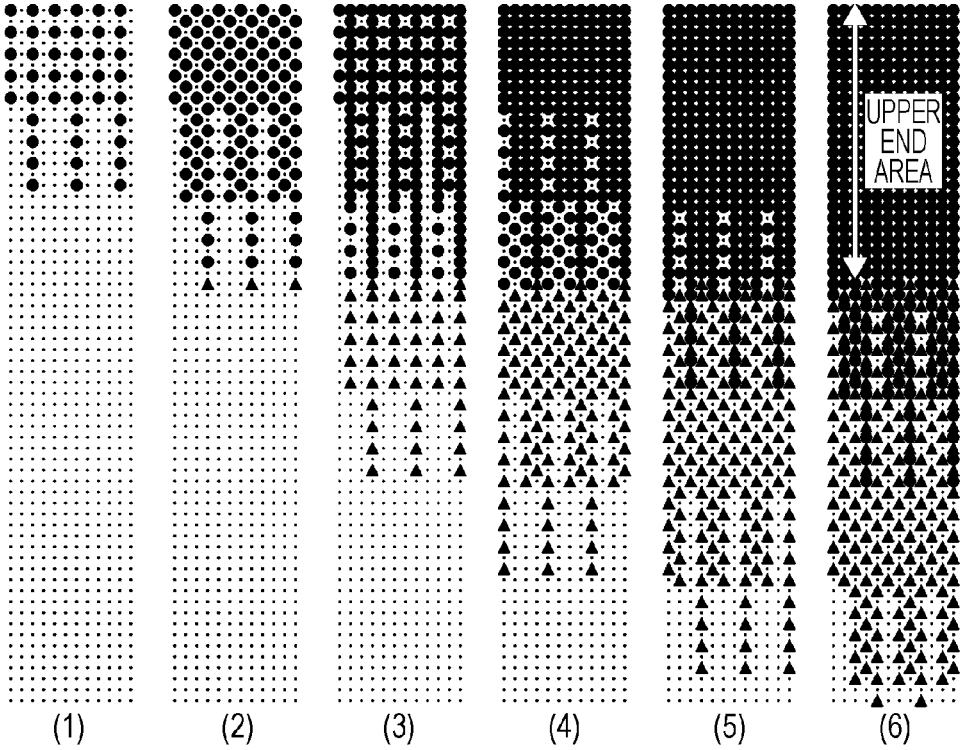

FIG. 8A and FIG. 8B are explanatory diagrams showing an example of the upper end processing, (1) to (4) in FIG. 8A show positions of both the virtual head set 42X and discharged ink droplets in each pass (pass 1 to pass 4) of the upper end processing, and (5) and (6) in FIG. 8A show positions of both the virtual head set 42X and discharged ink droplets in each pass (pass 5 and pass 6) of the normal processing following the upper end processing.

(1) to (6) in FIG. 8B show dots formed in the paper 10 in pass 1 to pass 6. In other words, a result where positions of ink droplets of (1) to (6) in FIG. 8A are caused to be sequentially overlapped with each other corresponds to (1) to (6) in FIG. 8B.

In the example shown herein, the upper end processing is performed in pass 1 to pass 4, and the normal processing is performed after pass 5. In the upper end processing, the paper 10 is transported by a transport quantity D of one dot (a transport quantity smaller than a transport quantity 9D in the normal processing) in the transport action performed between a pass and a pass.

In the upper end processing, and in the odd-numbered pass, each nozzle is located at a position of the odd numbered raster line. After the odd numbered pass, the paper 10 is transported by a transport quantity of one dot. Therefore, in the even numbered pass, each nozzle is located at a position of the even numbered raster line. As such, also in the upper end processing, the position of each nozzle is alternately located at the position of the odd numbered raster line or the even numbered raster line for each pass.

In the normal processing described above, each head forms dots in the zigzag lattice shape. Therefore, in a certain pass, a dot-forming position of the first head 42A is different from a dot-forming position of the second head 42B. For example, when the first head 42A forms a dot in the form of the odd numbered dots, the second head 42B forms a dot in the form of the even numbered dots.

However, in the upper end processing, in a certain pass, a dot-forming position of the first head 42A is identical to a dot-forming position of the second head 42B. For example, in pass 1, both of the first head 42A and the second head 42B form dots in the form of the odd numbered dots.

Further, since each head forms dots in the zigzag lattice shape in the normal processing described above, dot-forming positions of each head between a certain pass and the next pass are different from each other. For example, in a case where, in a certain pass, the first head 42A forms dots in the odd numbered dots and the second head 42B forms dots in the even numbered dots, in the next pass of the certain pass, the first head 42A forms dots in the form of the even numbered dots, and the second head 42B forms dots in the form of the odd numbered dots.

However, in the upper end processing, dot-forming positions of each head are changed in the order of the odd numbered dots (pass 1)→the even numbered dots (pass 2)→the even numbered dots (pass 3)→the odd numbered dots (pass 4). In other words, in the upper end processing, requisitely, there are dot-forming positions which are not different from each other between a certain pass and the next pass of the certain pass. For example, in pass 2 and pass 3, the dot-forming positions are identical to each other, that is, the same even numbered dots.

The reason why there is a difference between the normal processing and the upper end processing is that each head forms dots in the zigzag lattice shape in the normal processing, whereas, in the upper end processing, dots are formed in two time passes, that is, the first-half two passes among four time passes, and dots are formed in the zigzag lattice shape in the remaining second half two passes so as to be embedded between the dots of the zigzag lattice shape in the first-half two passes.

According to the dot forming method described above, the first-time to the 25th-time raster lines (the raster lines of the upper end side in the paper 10) are formed by only the first head 42A. In other words, as for usage rates of the heads when the first-time to the 25th-time raster lines are formed, the first head 42A has the usage rate of 100% and the second head 42B has the usage rate of 0%.

Figure 9:
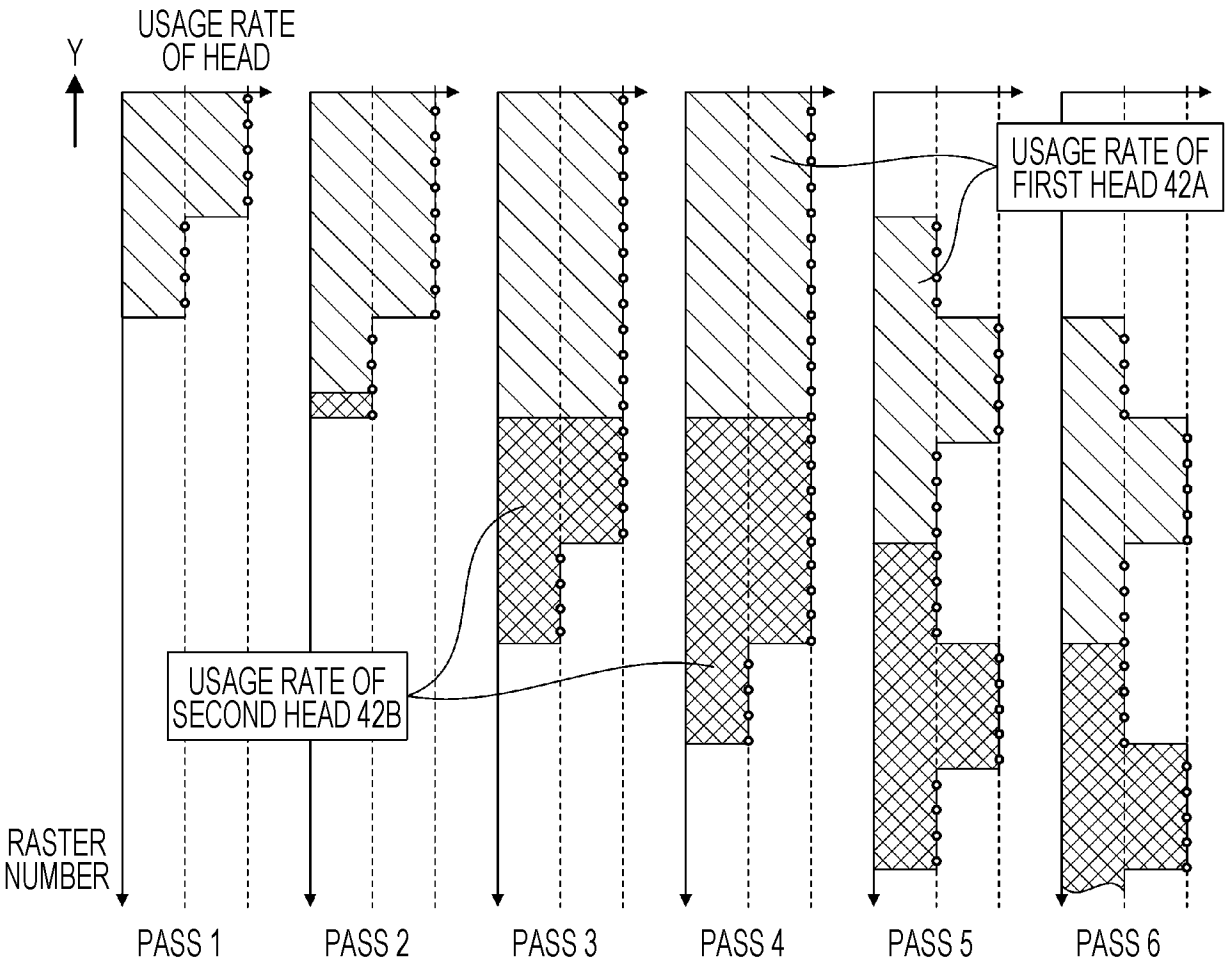
FIG. 9 is a schematic graph showing usage rates of the heads in passes 1 to 6.

FIG. 9 is a schematic graphic diagram showing usage rates of the first head 42A and the second head 42B in each pass (pass 1 to pass 6).

Up to now, for the sake of easy understanding, descriptions are made of only dots which are in the visible range. For this reason, as shown in FIG. 9, the change (difference between raster number directions) of a usage rate of each head is shown step by step. However, in actual use, an image is formed with a great number of dots each of which is formed of liquid droplets of several picoliters. Therefore, it is possible to show the change in a usage rate of each head in an approximately linear line or curve as shown below.

Figure 10:
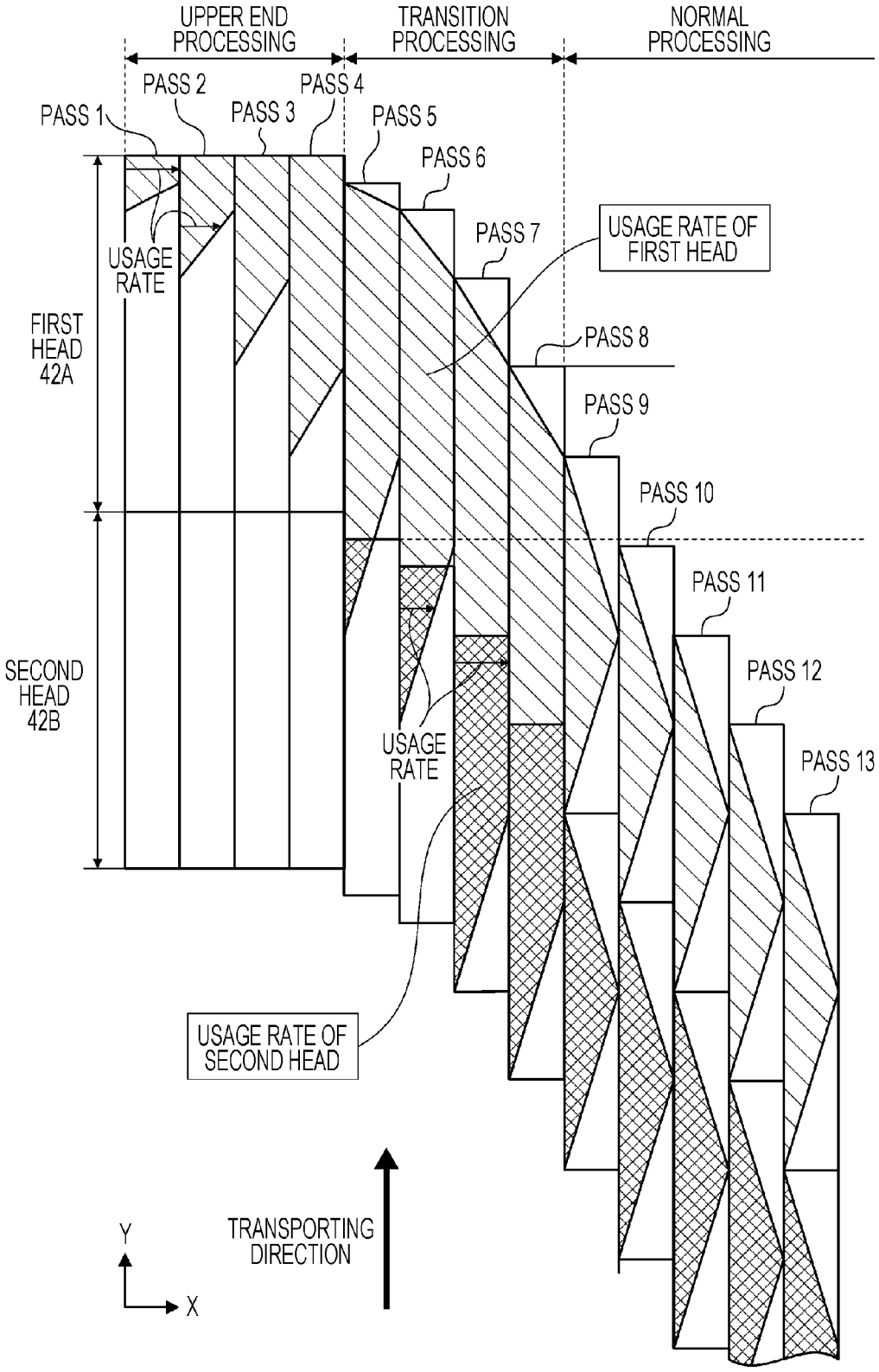
FIG. 10 is a graph showing usage rates of the heads in areas from the upper end processing to the normal processing.

FIG. 10 is a graphic diagram showing each usage rate of the first head 42A and the second head 42B in areas from the upper end processing to the normal processing.

FIG. 10 shows a head set based on the first head 42A and the second head 42B in a form in which the first head 42A and the second head 42B line up in a row in the Y direction, similarly to the virtual head set 42X shown in FIG. 5. Further, the transport unit 20 causes the paper 10 to be moved and thus the relative position of the paper 10 is generated. Similarly to FIG. 6, the relative position of the paper 10 is disposed in the slope direction so that the first head 42A and the second head 42B are not overlapped with each other. In other words, FIG. 10 shows that the first head 42A and the second head 42B are moved with respect to the paper 10, but actually the paper 10 is moved in the transporting direction (the Y direction). Further, in FIG. 10, the positional relationship of the first head 42A and the second head 42B in the X direction is meaningless. Further, the usage rate for each head (the usage rate of each nozzle belonging to each head for each raster line) is shown similarly to those shown in FIG. 9.

Pass 1 to pass 4 correspond to the upper end processing in which images are formed only by the first head 42A, and pass 5 to pass 8 correspond to a transition processing in which the usage rate of the second head 42B gradually increases, and passes 9 or more correspond to the normal processing in which the usage rates of the first head 42A and the second head 42B are respectively 50%. The areas to be formed in passes 5 or more correspond to image areas in which POL control is performed between two heads.

In other words, in the areas formed in the transition processing of pass 5 to pass 8, the usage rate of the first nozzle row (the first head 42A)>the usage rate of the second nozzle row (the second head 42B) is established, and relative usage ratio>the predetermined value Hk=1 is established.

Further, the transition processing shown in FIG. 10 is one example. The number of pass required for the transition processing or the number of the raster lines existing in the area in which the transition processing is performed are caused to be increased so that the change degree in the usage rate of the second head 42B can be reduced. In a case where there is a difference in ink discharging characteristics between the first head 42A and the second head 42B, as the amount of change decreases, it can be more difficult that much for the influence of the difference to be exposed to view.

Further, such transition processing is identically applied to not only the upper end of the paper 10 but also to the lower end of the paper 10. In other words, the transition processing is performed in which the usage rates of the first head 42A gradually decrease in the lower end, and images are formed only by the second head 42B in the lower end portion.

In the area of the transition processing with respect to the lower end area, the usage rate of the first nozzle row (the first head 42A)<the usage rare of the second nozzle row (the second head 42B) is established, and the relative usage ratio<the predetermined value Hk=1 is established.

Correction of Color Irregularity

As one of the differences in the ink discharging characteristics, there is a difference in a discharge quantity. There may be a case where ink quantities discharged from each nozzle row (the first head 42A and the second head 42B) are not equal to each other due to the influence of manufacturing errors and the like. For this reason, the nozzle row which discharges an ink in a quantity greater than a reference equivalent is likely to perform darker printing, and the nozzle row which discharges an ink in a quantity smaller than the reference equivalent is likely to perform lighter printing. As a result, there is a possibility that color irregularity may occur in the printed images.

Therefore, the following correction processing of color irregularity is used to suppress color irregularity of the printed image. Hereinafter, the correction processing of color irregularity will be described in sequential procedures.

Acquirement Processing of Correction Value of Color Irregularity

Figure 11:
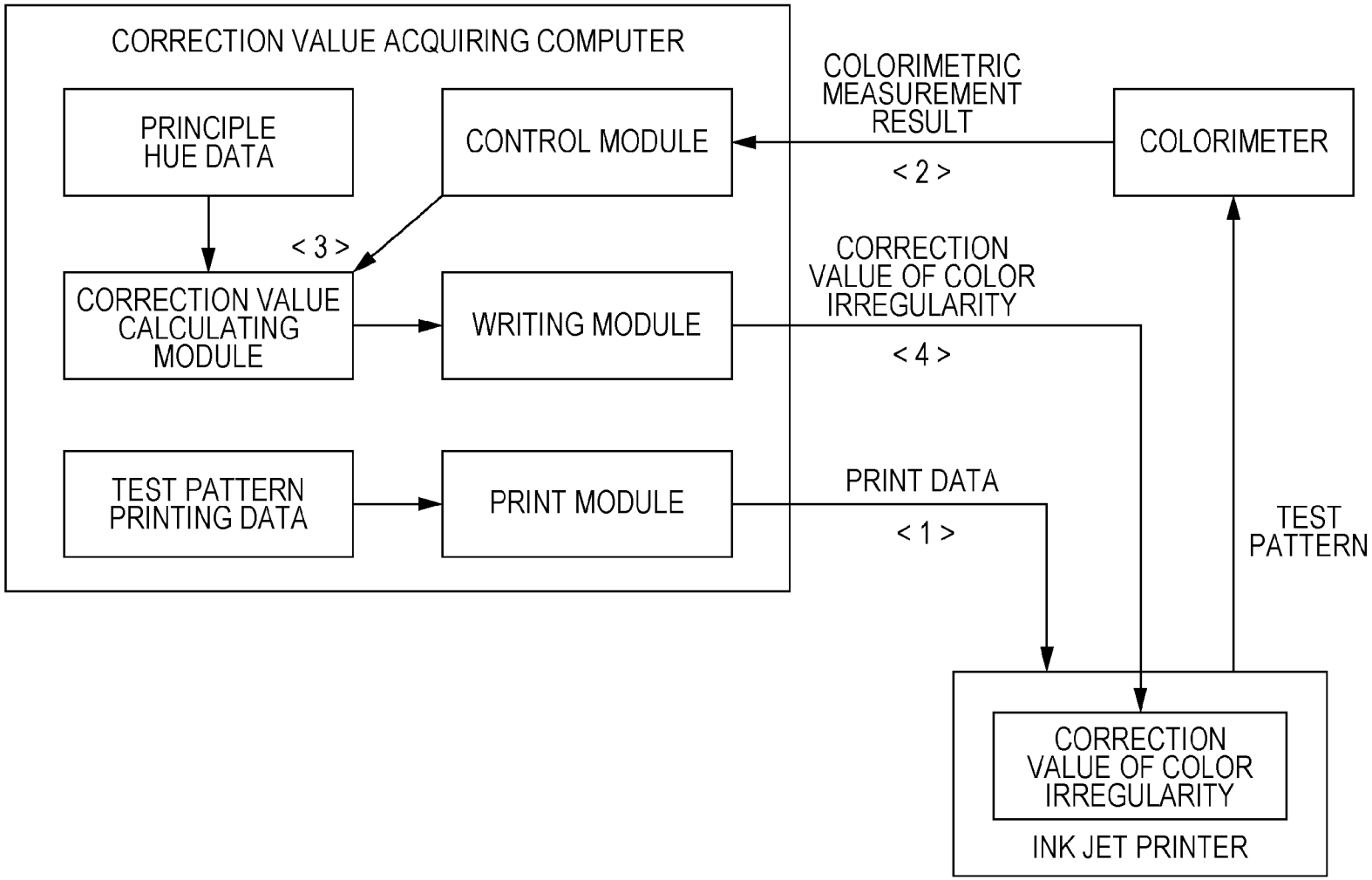
FIG. 11 is an explanatory diagram showing acquirement processing of a correction value of color irregularity.

FIG. 11 is an explanatory diagram showing acquirement processing of correction values of color irregularity in a factory for manufacturing the ink jet printer 100. In the factory for manufacturing the ink jet printer 100, a correction value acquiring computer, and a colorimeter connected to the computer are prepared. If the ink jet printer 100 is manufactured in the factory, then the ink jet printer 100 is connected to the correction value acquiring computer. Each module illustrated in the computer shown in FIG. 11 is configured to include software and hardware.

Firstly, a print module of the computer generates print data based on test pattern printing data and transmits the generated print data to the ink jet printer 100. The print module corresponds to a so called printer driver. The test pattern printing data is previously stored in a memory of a computer.

Subsequently, the ink jet printer 100 which receives the print data prints a test pattern, and a measurer uses a colorimeter to perform colorimetric measurement with respect to the printed test pattern. The test pattern includes a plurality of patch patterns such as a pattern (a first pattern) which is configured to include dot rows formed by the first nozzle row (the first head 42A), and a pattern (the second pattern) which is configured to include dot rows formed by the second nozzle row (the second head 42B) so as to obtain a correction value of color irregularity (color shift) for each nozzle row. A control module acquires a colorimetric measurement result of each patch pattern from the colorimeter.

Subsequently, a correction value calculating module compares the colorimetric measurement result with a previously stored principle hue data and calculates a correction value of color irregularity (a value to be corrected) for each nozzle row.

Finally, a writing module writes the correction value of color irregularity into the memory 63 of the ink jet printer 100. In a state where the correction value of color irregularity for each nozzle rows is stored in the memory 63, the ink jet printer 100 is shipped from the factory.

FIG. 12 is an explanatory diagram showing correction values of color irregularity. In each of the first nozzle group (the first nozzle group 41A) and the second nozzle group (the second nozzle group 41B), a correction value of color irregularity is respectively prepared. Further, three types (a small dot, a medium dot and a large dot) of correction values of color irregularity are prepared for each nozzle row (for each ink color).

In FIG. 12, in a case where a correction value is "100", the colorimetric measurement result is identical to the principle hue data and the same quantity of ink as the reference equivalent is discharged from the nozzle. For example, a nozzle row of cyan (the second nozzle row) in the second nozzle group discharges the same quantity of ink as the reference equivalent when discharging the small dot.

A case where the correction value is 100 or more means that the colorimetric measurement result has a greater density (is darker) than that of the principle hue data and a greater quantity of ink than the reference equivalent is discharged from the nozzle. For example, a nozzle row of cyan (the first nozzle row) in the first nozzle group discharges a greater quantity of ink than the reference equivalent when discharging the small dot. For this reason, if this nozzle row forms dots, the formed dots become a dark image.

A case where the correction value is 100 or less means that the colorimetric measurement result has a lower density than that of the principle hue data, and a quantity of ink which is smaller than the reference equivalent is discharged from the nozzle. For example, a nozzle row of cyan in the first nozzle group discharges a quantity of ink smaller that the reference equivalent when discharging the large dot. For this reason, if this nozzle row forms dots, the formed dots become a light image.

Further, in the above description, the colorimetric measurement is performed with respect to the test pattern to cause the correction value of color irregularity to be acquired, but the embodiment is not limited thereto. For example, the quantity of the discharged ink droplets may be directly measured to cause the correction value of color irregularity to be acquired as shown in FIG. 12.

Processing During Printing

Figure 13:
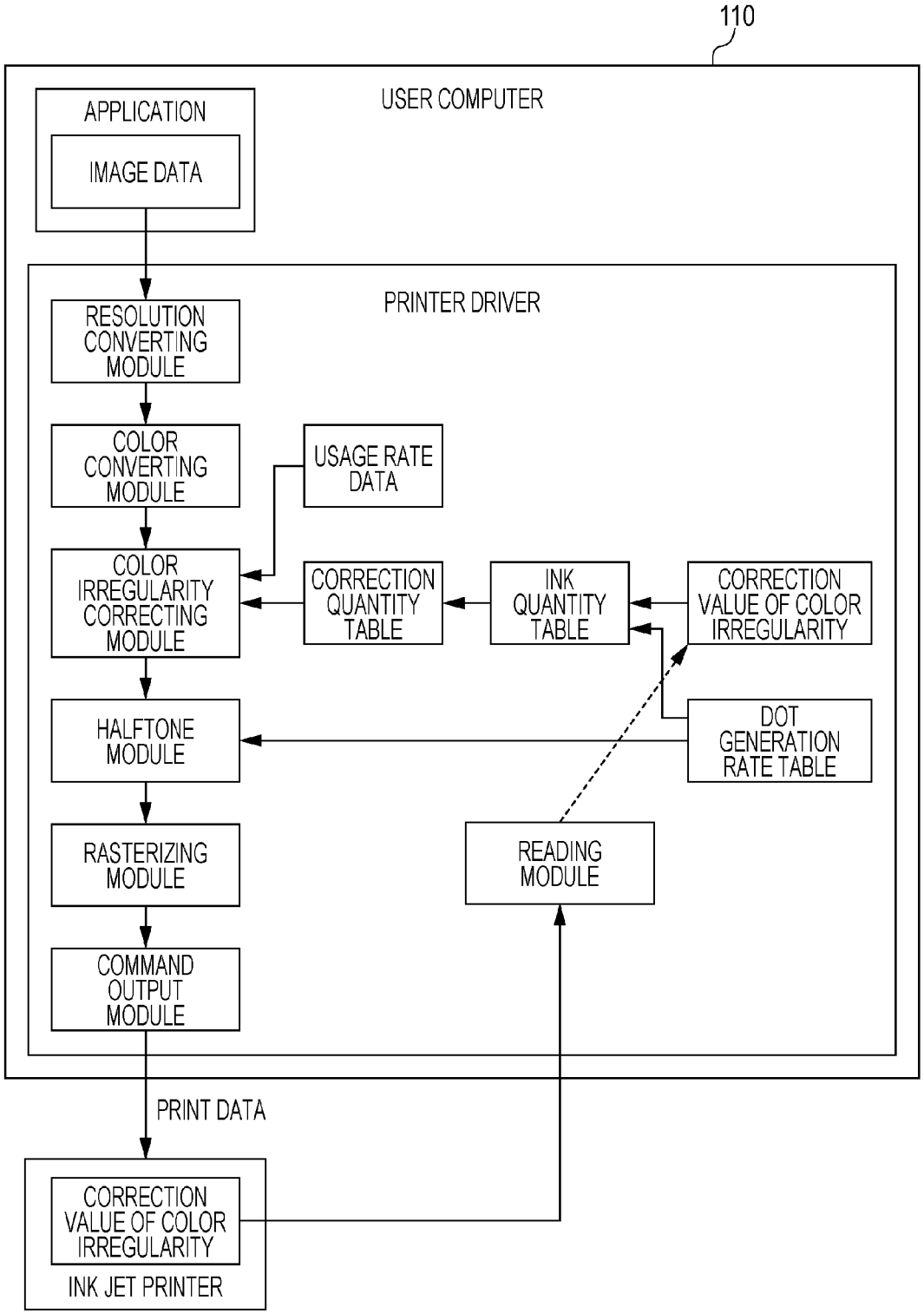
FIG. 13 is a block diagram showing print processing under control of a user according to the related art.
Figure 14:
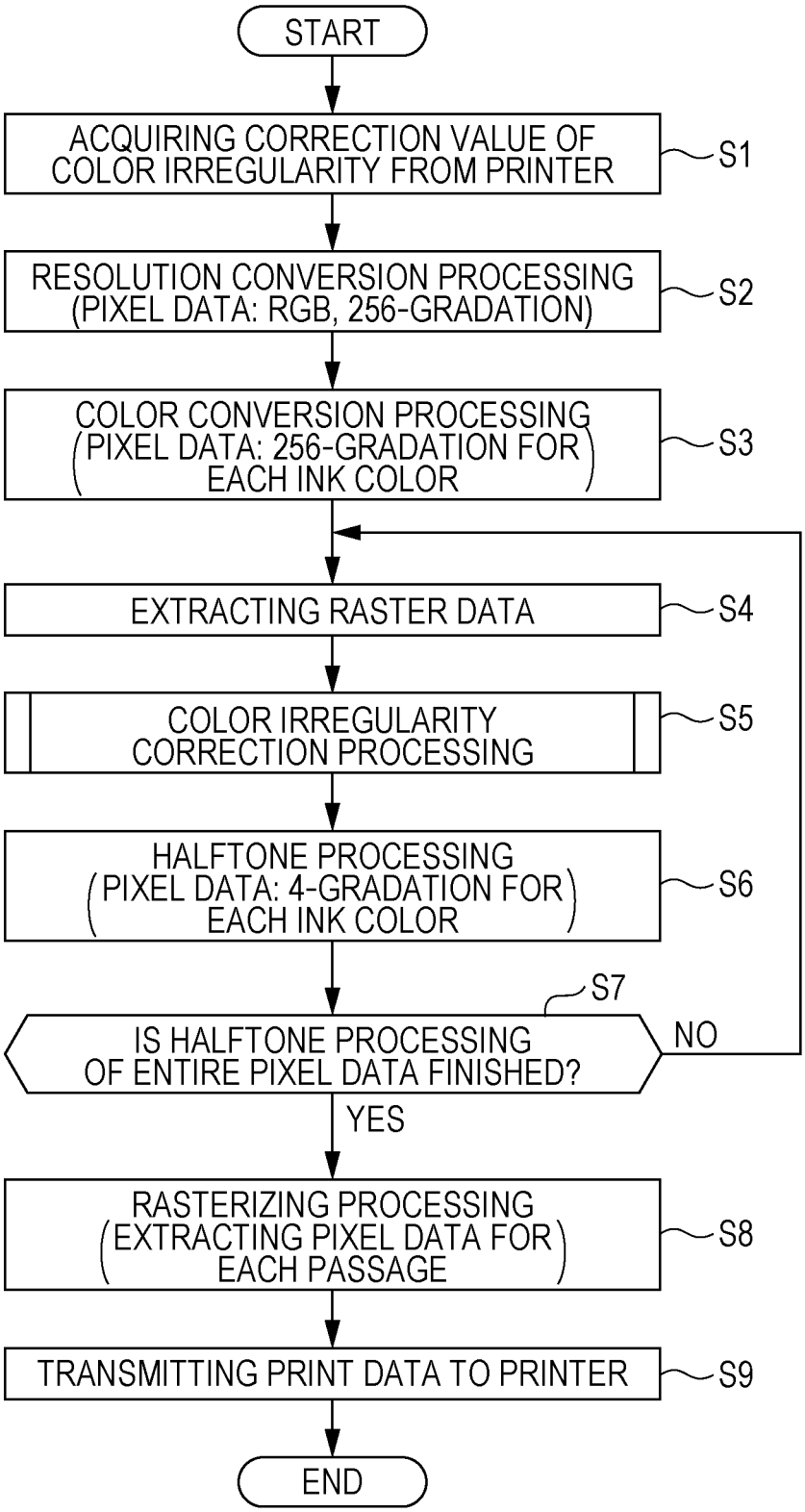
FIG. 14 is a flow chart showing processing performed by a printer driver according to the related art.

FIG. 13 is a block diagram showing print processing under control of a user according to the related art. FIG. 14 is a flow chart showing processing performed by a printer driver. The printer driver is a program operated in the PC 110, and causes each module in FIG. 13 or each processing in FIG. 14 to be realized in collaboration with hardware of the PC 110 (a CPU, a memory, or the like).

Further, each drawing corresponds to a technique of the related art. Hereinafter correction processing of color irregularity according to the related art will be described.

Firstly, the printer driver acquires a correction value (see FIG. 12) of color irregularity from the memory 63 of the ink jet printer 100 (S1, see FIG. 14). The printer driver causes the acquired correction value of color irregularity to be stored in the memory of the PC 110.

Subsequently, the printer driver uses a resolution converting module to perform resolution conversion processing (S2). The resolution conversion processing corresponds to a process which causes image data (text data, image data, and the like) output from an application to be converted to image data of a resolution (a print resolution) to be printed on the paper 10. For example, in a case where the print resolution is designated to be 1440×720 dpi, image data of vector format which is received from the application is converted into the image data having the resolution of 1440×720 dpi. Each piece of pixel data of the image data after the resolution conversion processing corresponds to the data indicating a gradation value of 256-gradation in an RGB color space.

Further, an image representing the image data after the resolution conversion processing is configured to include pixels disposed in a matrix-like shape. Each pixel has a gradation value of 256-gradation in an RGB color space. The pixel data after the resolution conversion processing indicates a gradation value of the correlated pixel. The pixel data which correlates to pixels of one row lined up in the horizontal direction among pixels disposed in the matrix-like shape, will be referred to as "raster data" in the description made below.

Further, the direction in which the pixels correlating to the raster data lines up corresponds to the moving direction (scanning direction) in which the head 41 is moved when an image is printed.

Subsequently, the printer driver uses a color converting module to perform color conversion processing (S3). The color conversion processing corresponds to a process which causes data in the RGB color space to be converted into data in the color space which corresponds to ink colors of the ink jet printer 100. The pixel data after the color conversion processing corresponds to data indicating a gradation value of 256-gradation which is represented by an eight-dimensional color space of C·M·Y·K·LC·LM·LK·LLK.

Subsequently, the printer driver extracts raster data (S4). Specifically, the pixel data which corresponds to pixels of one row lined up in the horizontal direction from image data of a certain color (for example, cyan) is extracted.

Subsequently, the printer driver uses a color irregularity correcting module to perform correction processing of color irregularity with respect to the extracted raster data (S5). The correction processing of color irregularity will be described later.

Subsequently, the printer driver uses a halftone module to perform half tone processing (S6). The half tone processing is a process which causes the pixel data of the 256-gradation to be converted into pixel data of 4-gradation, and the pixel data of the 4-gradation is available for the ink jet printer 100 to form an image. The pixel data of the 4-gradation after the half tone processing is data indicating the size of a dot formed in a correlated pixel. Specifically, the pixel data of the 4-gradation indicates any one of a large dot·medium dot·small dot·non-dot.

Further, the printer driver uses a dot generation rate table (see FIG. 16A described later) during the half tone processing. The dot generation rate table corresponds to a data table which indicates the probability (dot generation rate) with which each dot among a small dot·a medium dot·a large dot is generated for each gradation value of 256-gradation. Specifically, for example, a gradation value 20 correlates to the small dot generation rate 40% and the medium dot•the large dot generation rate 0%. In other words, if the gradation value of 256-gradation in a certain pixel data is 20, the result of the half tone processing, that is, the pixel data thereof is converted into pixel data (4-gradation) representing small dots with the probability of 40%, and is converted into pixel data (4-gradation) representing a non-dot with the probability of 60%.

Subsequently, the printer driver determines whether or not the half tone processing of all of the pixel data is finished (S7). For example, the printer driver determines No in a case where there is other raster data for cyan, and the printer driver determines No also in a case where there is raster data for other color.

Subsequently, the printer driver uses a rasterizing module to perform a rasterizing processing (S8). The rasterizing processing corresponds to a process in which pixel data of a pixel for each pass as a dot-forming target is extracted from image data, and pixel data for each pass is replaced with the extracted pixel data.

Finally, the printer driver uses a command output module to add command data to pixel data which goes through the rasterizing processing, and thereby generates print data and transmits the print data to the ink jet printer 100 (S9). The ink jet printer 100 controls each unit according to the command data included in the print data, and causes ink to be discharged from each nozzle according to pixel data included in the print data, and thus dots are formed on the paper 10 to cause an image to be printed.

Correction Processing of Color Irregularity (a Technique of the Related Art

Figure 15:
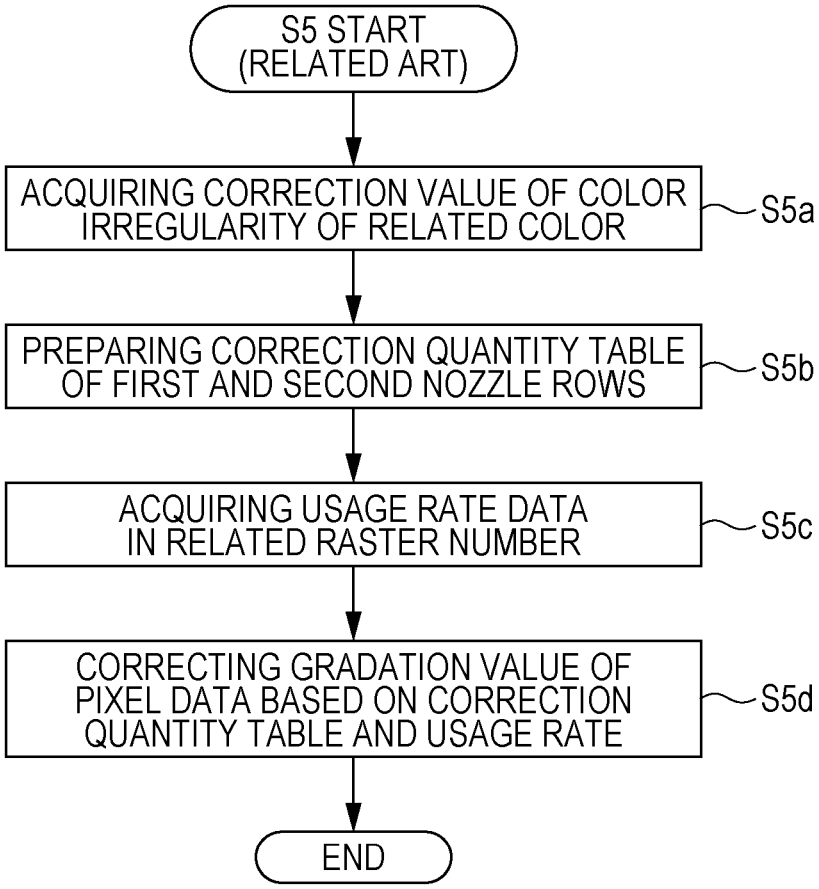
FIG. 15 is a flow chart showing correction processing of color irregularity (the related art).

FIG. 15 is a block diagram showing correction processing (S5) of color irregularity.

Firstly, the printer driver uses a reading module (see FIG. 13) to acquire a correction value of color irregularity for a related color from the memory 63 of the ink jet printer 100 (S5*a*). For example, when correction processing of color irregularity is performed with respect to raster data of image data for cyan, a correction value of color irregularity for cyan is acquired. In this case, the printer driver acquires both a correction value of color irregularity correlating to the first nozzle row (the first head 42A) and a correction value of color irregularity correlating to the second nozzle row (the second head 42B).

Subsequently, a correction quantity table is prepared for each nozzle row (S5*b*). In other words, a first correction quantity table is prepared in which an ink droplet quantity discharged from the nozzle of the first nozzle row (the first head 42A) is obtained according to the first pattern and the obtained ink droplet quantity (a discharged ink quantity per a unit area in print media) is corrected, and a second correction quantity table is prepared in which an ink droplet quantity discharged from the nozzle of the second nozzle row (the second head 42B) is obtained according to the second pattern and the obtained ink droplet quantity (a discharged ink quantity per a unit area in print media) is corrected.

Herein, before the correction quantity table is described, the ink quantity to be discharged will be described with reference to FIG. 16A to FIG. 16C.

Figure 16A:
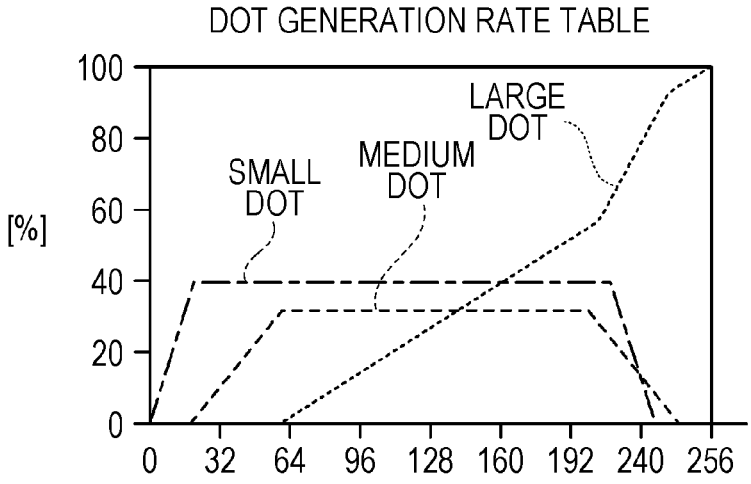
FIG. 16A is a graph showing a dot generation rate table used for halftone processing.

FIG. 16A shows a dot generation rate table used for half-tone processing. In the drawing, the horizontal axis indicates the gradation value of the 256-gradation, and the vertical axis indicates the dot generation rate. As shown in the drawing, for example, the gradation value 20 correlates to the small dot generation rate 40% and the medium dot•large dot generation rate 0%.

Figure 16B:
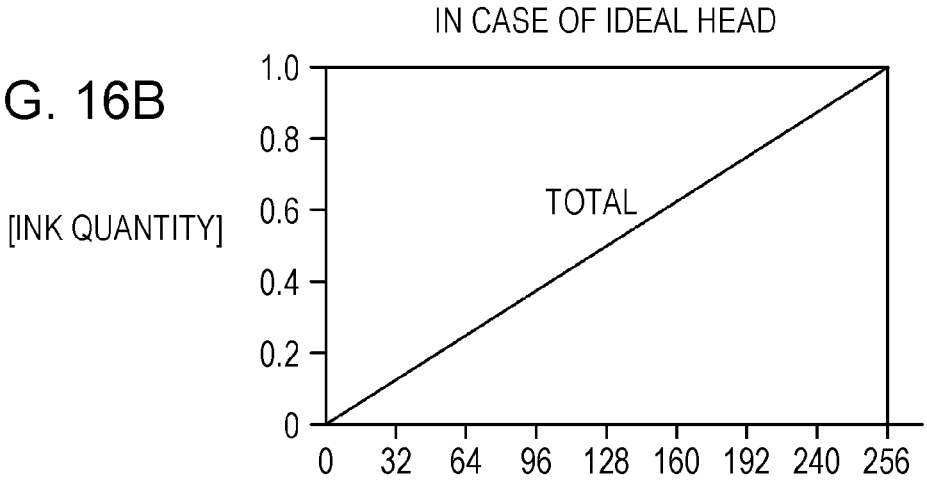
FIG. 16B is a graph showing a relationship between ink quantities and gradation values in a case where ink is discharged by a reference equivalent.

FIG. 16B is a graph showing a relationship between an ink quantity and a gradation value in a case where ink is discharged at a reference equivalent. In the drawing, the horizontal axis indicates the gradation value of the 256-gradation and the vertical axis indicates the ink quantity when a discharged ink quantity (a liquid droplet quantity) per a unit area in the case of the gradation value 256 is assumed to be 1. In the state shown in the drawing, and in a case where ink is discharged at a reference equivalent, the ink quantity is discharged in proportion to the gradation value.

It is not necessary for the gradation value and the ink quantity to be in a proportional relationship to each other. However, for the sake of easy understanding of description, hereinafter, a description will be made of ideal heads which are assumed to be in a state of such a proportional relationship.

Figure 16C:
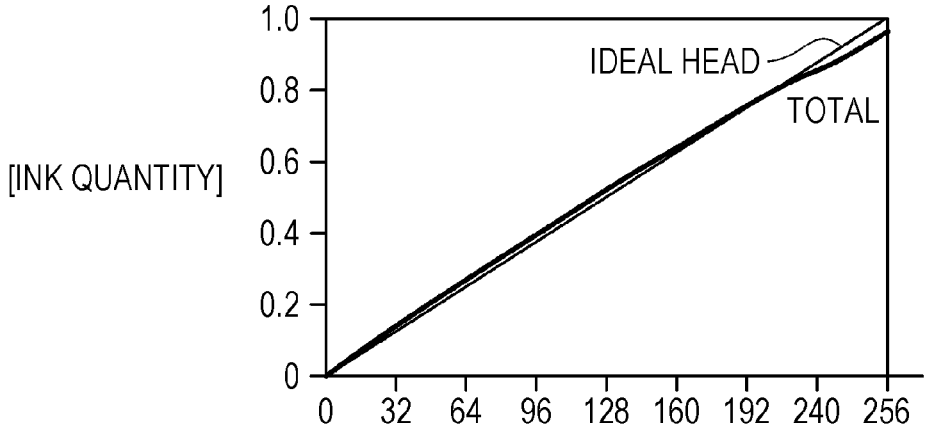
FIG. 16C is a graph showing a relationship between ink quantities and gradation values in a case where ink is discharged at a quantity different from the reference equivalent.

FIG. 16C is a graph showing a relationship between a quantity of ink and a gradation value in a case where ink is discharged at a quantity different from a reference equivalent. A thin line corresponds to the graph in FIG. 16B, and a bold line is the graph curve indicating a relationship between a quantity of ink and a gradation value in a case where ink is discharged at a quantity different from a reference equivalent. Herein, the drawing shows a graph in a case where ink is discharged from a nozzle row in which a correction value of color irregularity for the small dot is 110, a correction value of color irregularity for the medium dot is 108 and a correction value of color irregularity for the large dot is 96. As shown in the drawing, at the low gradation values in which small dots and medium dots are mainly discharged, the discharged ink quantity is greater than the reference equivalent. On the other hand, at the high gradation value in which large dots are mainly discharged, the discharged quantity of ink is smaller than the reference equivalent.

As shown in FIG. 16C, it is possible to calculate the relationship between a gradation value and a quantity of ink based on the dot generation rate table and the correction value of color irregularity. Therefore, during processing of S5*b*, the printer driver first calculates the ink quantity table indicating the relationship between the gradation value and the quantity of ink shown in FIG. 16C based on the dot generation rate table and the correction value of color irregularity acquired in S5*a*.

Figure 17:
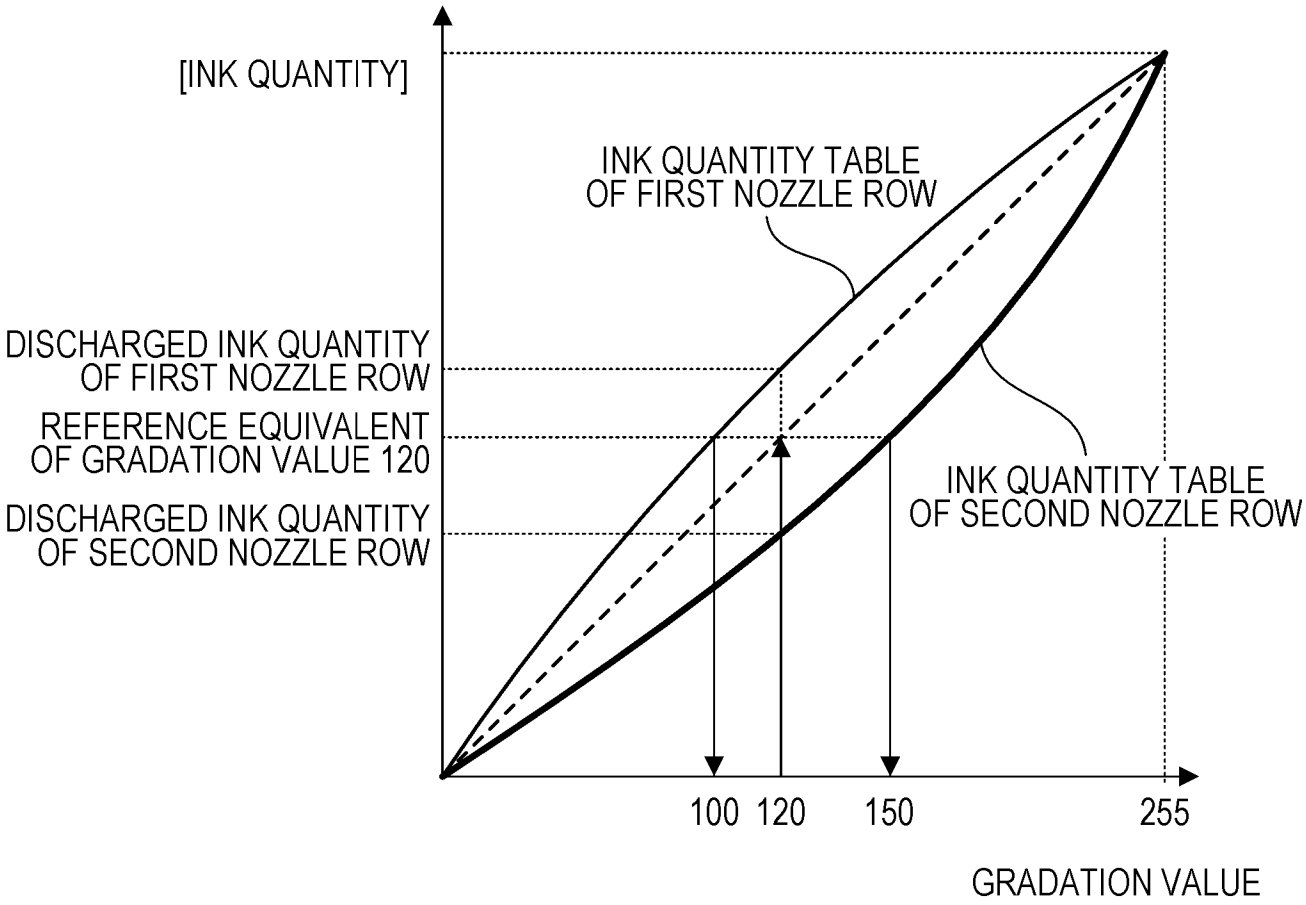
FIG. 17 is an explanatory diagram explaining a meaning of an ink quantity table.

FIG. 17 is an explanatory diagram showing a meaning of an ink quantity table. The graph of a broken line in the drawing represents the graph of the quantity of ink in FIG. 16B, that is, the graph of the ink quantity table in a case where ink is discharged at the reference equivalent. A graph of a solid line in the drawing represents a graph of an ink quantity table in a case where ink is discharged at a quantity different from a reference equivalent. In the graphs of the solid line, a graph of a thin line corresponds to a graph of ink quantity table of the first nozzle row (the first head 42A), and a graph of bold line corresponds to a graph of the ink quantity table of the second nozzle row (the second head 42B).

For example, in a case where the gradation value indicating pixel data is 120, if ink is discharged without correction of the gradation value, the ink is discharged from the first nozzle row (the first head 42A) at a quantity greater than the reference equivalent, and the ink is discharged from the second nozzle row (the second head 42B) at a quantity smaller than the reference equivalent. On the other hand, in a case where a gradation value correlating to the reference equivalent of the gradation value 120 is assumed to be 100 in the ink quantity table of the first nozzle row (the first head 42A), if the ink is discharged from the first nozzle row (the first head 42A) according to the gradation value 100, it may be considered that the ink can be discharged from the first nozzle row (the first head 42A) by the reference equivalent of the gradation value 120. Further, in a case where a gradation value correlating to the reference equivalent of the gradation value 120 is assumed to be 150 in the ink quantity table of the second nozzle row (the second head 42B), if the ink is discharged from the second nozzle row (the second head 42B) according to the gradation value 150, it is considered that the ink can be discharged from the second nozzle row (the second head 42B) at the reference equivalent of the gradation value 120.

Herein, the printer driver causes gradation value 100 to correlate to gradation value 120 in the correction quantity table of the first nozzle row (the first head 42A). In other words, a correction quantity table is prepared in which when a gradation value that is input (an input gradation value) is 120, gradation value 100 is output. Based on the ink quantity table, an output gradation value is caused to correlate also to another input gradation value, and thereby the printer driver causes a correction quantity table of the first nozzle row (the first head 42A) to be prepared.

The printer driver causes such a correction quantity table to be prepared for each nozzle row. In the embodiment, a first correction quantity table of the first nozzle row (the first head 42A) and a second correction quantity table of the second nozzle row (the second head 42B) are prepared. Further, as seen in the above description, the first correction quantity table is prepared according to a correction value of color irregularity of the first nozzle row (the first head 42A) and a dot generation rate table, and the second correction quantity table is prepared according to a correction value of color irregularity of the second nozzle row (the second head 42B) and a dot generation rate table.

FIG. 18 is an explanatory diagram showing examples of the first correction quantity table and the second correction quantity table. As such, the correction quantity table in which the input gradation value and the output gradation value are caused to correlate to each other is prepared for each nozzle row.

Further, when correction processing of color irregularity with respect to raster data of a certain color is performed, a prepared correction quantity table is stored in the memory 63, and when correction processing of color irregularity with respect to another piece of raster data of the same color as the certain color is performed, the stored correction quantity table may be again used. In other words, in a case where the correction quantity table is already prepared, the printer driver may omit the processing (S5*b*) for preparing the correction quantity table.

After a correction quantity table is prepared, the printer driver acquires usage rate data in a raster number correlating to the raster data extracted in S4, based on a usage rate (see FIG. 10) of each head (S5*c*).

If a raster line correlating to raster data belongs to the upper end area, the usage rate of the first nozzle row (the first head 42A) is 1 (100%), and the usage rate of the second nozzle row (the second head 42B) is 0 (0%). Further, if a raster line corresponding to raster data belongs to the normal area, the usage rate of the first nozzle row (the first head 42A) is 0.5 (50%), and the usage rate of the second nozzle row (the second head 42B) is also 0.5 (50%). The transition area exists between the upper end area and the normal area, and in the transition area, there is a raster line in which the usage rate of the first nozzle row (the first head 42A) is between 0.5 to 1. For example, there is, in the transition area, a raster line in which the usage rate of the first nozzle row (the first head 42A) is caused to be 0.75 (75%).

The relationship between the raster number and the usage rate is primarily determined if the dot forming method is determined.

Subsequently, the printer driver corrects a gradation value of each piece of pixel data in raster data based on the correction quantity table and the usage rate data (S5*d*).

For example, in a case where a gradation value of pixel data is 120 and the usage rate of the first nozzle row (the first head 42A) is 1, the gradation value after correction is 100. Further, in a case where a gradation value of pixel data is 120 and the usage rate of the first nozzle row (the first head 42A) is 50%, the gradation value after correction is 125 ($=100\times0.5+150\times0.5$). Further, in a case where a gradation value of pixel data is 120, and the usage rate of the first nozzle row (the first head 42A) is 75%, the gradation value after correction is 112.5 ($=100\times0.75+150\times0.25$). As such, the printer driver uses a gradation value (for example 120) of pixel data as an input gradation value to thereby obtain each output gradation value (for example, 100 and 150) based on a correction quantity table of each nozzle row. Further, the printer driver adds an output gradation value to which each usage rate (for example, 0.75 and 0.25) is weighted in order to calculate a gradation value after correction (for example, 112.5).

If the gradation values of all of the pixel data of the raster data are corrected, the printer driver finishes the correction processing of color irregularity.

Correction of Color Irregularity Based on Relative Positional Shift of a Dot Between Heads (Nozzle Rows)

As described above, according to the related art, the description is finished in which the dot forming method includes the upper end processing and the lower end processing and the correction method of color irregularity. According to the related art, in a case where both the first nozzle row (the first head 42A) and the second nozzle row (the second head 42B) are used, each usage rate is weighted for each correction quantity table so as to cause the result to be reflected in the correction. However, in the related art, there is no consideration with respect to the color irregularity which is generated due to the positional shift of dots between the first nozzle row (the first head 42A) and the second nozzle row (the second head 42B).

In "the liquid droplet discharging apparatus (the ink jet printer 100)" and "the liquid droplet discharging method" according to the embodiment, and in the dot forming method including the upper end processing and the lower end processing, a liquid droplet quantity, per a unit area in print media, discharged from the first nozzle row (the first head 42A) and/or the second nozzle row (the second head 42B), is corrected so as to suppress color irregularity which is generated due to relative positional shifting of dots. Hereinafter, the description thereof will be specifically made.

Third Correction Quantity Table

In the embodiment, in addition to the first correction quantity table and the second correction quantity table as described above, a third correction quantity table is previously acquired and thus based on information including the acquired third correction quantity table, correction is performed.

The third correction quantity table corrects a liquid droplet quantity, per a unit area in print media, discharged from the first nozzle row and the second nozzle row, and the liquid droplet quantity is obtained according to a pattern which is configured to include dot rows formed due to discharging in the normal processing area in which a relative usage ratio of the first nozzle row (the first head 42A) to the second nozzle row (the second head 42B) is the predetermined value Hk.

Similarly to the first correction quantity table and the second correction quantity table, the third correction quantity table is generated from a correction value of color irregularity which is acquired in a factory for manufacturing the ink jet printer 100. In a test pattern (see FIG. 11) that acquires a correction value of color irregularity for generating the third correction quantity table, a pattern which is configured to include dot rows formed due to discharging of a relative usage ratio that is a predetermined value Hk (for example, 1) is used so as to cause the color irregularity (color shift) due to a relative positional shift of the nozzles between the nozzle rows to be detected. A colorimeter is used to perform a colorimetric measurement with respect to the printed test pattern, and a correction value calculating module compares the result of the colorimetric measurement with the previously stored principle hue data to thereby calculate a correction value of color irregularity. In a state where the correction value of color irregularity is stored in the memory 63 of the ink jet printer 100, the ink jet printer 100 is shipped from the factory. And under control of a user, the printer driver performs processing to prepare the third correction quantity table based on the correction value of color irregularity and the dot generation rate table, similarly to the cases of the first correction quantity table and the second correction quantity table.

FIG. 19 is an explanatory diagram showing an example of the third correction quantity table obtained through the processing described above.

The third correction quantity table is obtained as a data table that corrects ink discharge characteristics of the first nozzle row (the first head 42A) and the second nozzle row (the second head 42B), and that corrects the influence generated due to relative positional shifts of nozzles.

By addition of the third correction quantity table, and based on the first correction quantity table, the second correction quantity table, a relative usage ratio of each nozzle row, and the third correction quantity table, a liquid droplet quantity discharged from the first nozzle row (the first head 42A) and/or the second nozzle row (the second head 42B) is corrected.

Correction Processing of Color Irregularity

Figure 20:
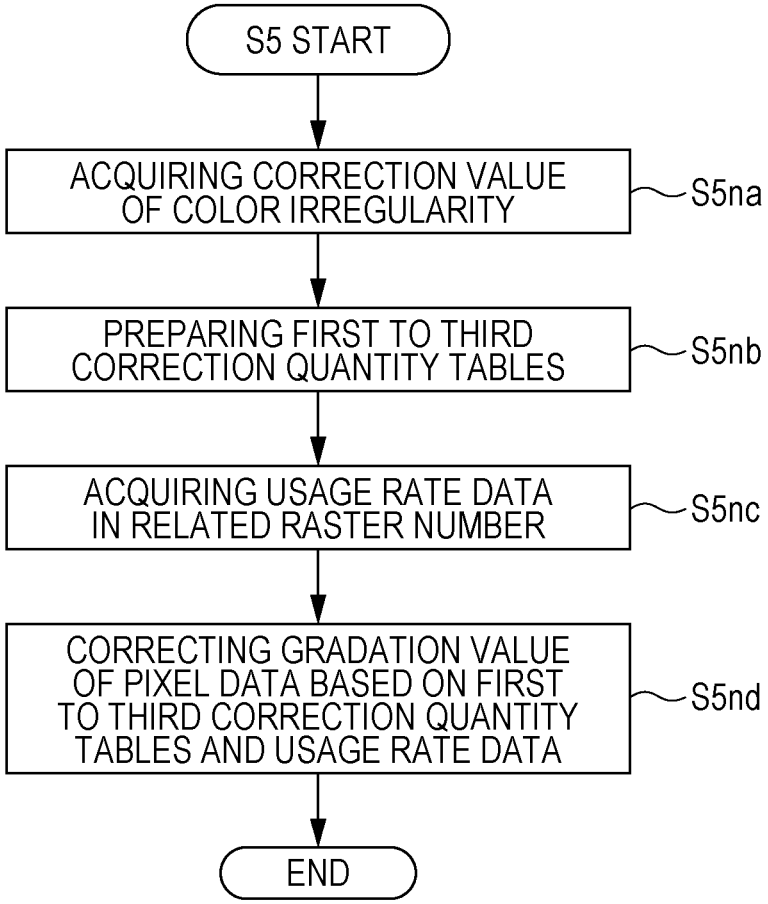
FIG. 20 is a flow chart showing a correction processing of color irregularity according to the first embodiment.

FIG. 20 is a flow chart showing a correction processing of color irregularity according to the embodiment.

Firstly, the printer driver uses the reading module (see FIG. 13) to acquire a correction value of color irregularity from the memory 63 of the ink jet printer 100 (S5*na*). For example, when the correction processing of color irregularity is performed with respect to raster data of image data for cyan, a correction value of color irregularity for cyan is acquired. In this case, the printer driver acquires respectively a correction value of color irregularity correlating to the first nozzle row (the first head 42A), a correction value of color irregularity correlating to the second nozzle row (the second head 42B), and a correction value of color irregularity correlating to a relative usage ratio of the predetermined value Hk.

Subsequently, the correction quantity table is prepared (S5*nb*). In other words, a first correction quantity table is prepared in which an ink droplet quantity discharged from the nozzle of the first nozzle row (the first head 42A) is corrected, a second correction quantity table is prepared in which an ink droplet quantity discharged from the nozzle of the second nozzle row (the second head 42B) is corrected, and a third correction quantity table is prepared in which an ink droplet quantity discharged at a relative usage ratio of a predetermined value Hk is corrected.

Further, when correction processing of color irregularity with respect to raster data of a certain color is performed, a prepared correction quantity table is stored in the memory 63, and when correction processing of color irregularity with respect to another piece of raster data for the same color as the certain color is performed, the stored correction quantity table may be used again. In other words, in a case where the correction quantity table is already prepared, the printer driver may omit the processing (S5*nb*) for preparing the correction quantity table.

After the first to the third correction quantity tables are prepared, the printer driver acquires usage rate data in a raster number correlating to raster data extracted in S4, based on a usage rate (see FIG. 10) of each head (S5*nc*).

Subsequently, the printer driver corrects a gradation value of each pixel data in raster data based on the first to the third correction quantity tables and the usage rate data (the relative usage ratio) (S5*nd*).

Figure 21:
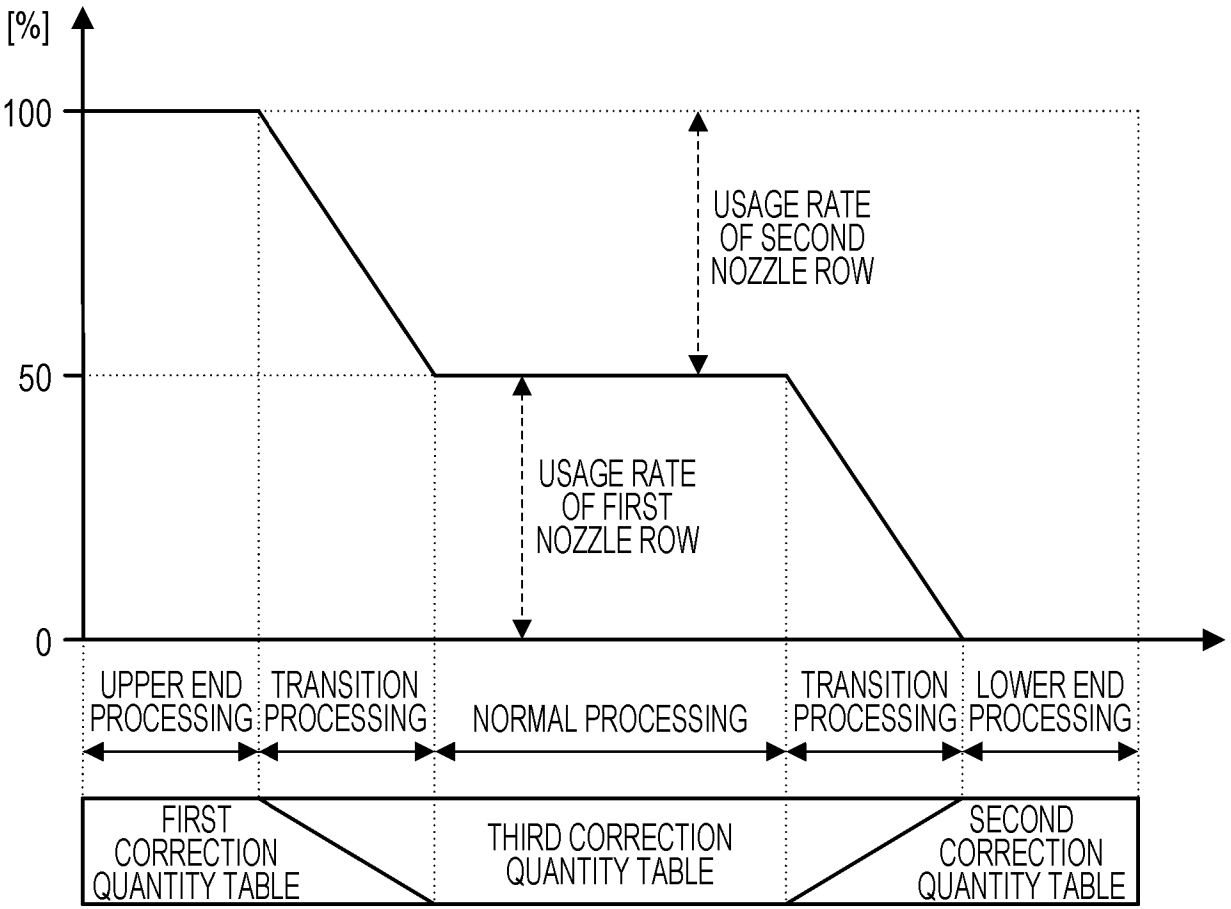
FIG. 21 is a conceptual diagram showing a weighting relationship of each correction quantity table in each area between the upper end area and the lower end area.

FIG. 21 is a conceptual diagram showing a weighting relationship of a correction quantity table in each area between the upper end area and the lower end area.

In a case where a relative usage ratio>a predetermined value Hk is established, that is, in a case where the usage rate of the first nozzle row (the first head 42A) is greater than the usage rate of the second nozzle row (the second head 42B), based on the first correction quantity table, the third correction quantity table, and the relative usage ratio, a liquid droplet quantity discharged from the first nozzle row (the first head 42A) and/or the second nozzle row (the second head 42B) is corrected. Further, in a case where the relative usage ratio<the predetermined value Hk is established, that is, in a case where the usage rate of the second nozzle row (the second head 42B) is greater than the usage rate of the first nozzle row (the first head 42A), based on the second correction quantity table, the third correction quantity table, and the relative usage ratio, a liquid droplet quantity discharged from the first nozzle row (the first head 42A) and/or the second nozzle row (the second head 42B) is corrected.

For example, in a case where a gradation value of pixel data is 120 and the usage rate of the first nozzle row (the first head 42A) is 100%, that is, in the upper end area, the gradation value after correction is 100 (see the first correction quantity table in FIG. 18).

Further, in a case where a gradation value of pixel data is 120 and the relative usage ratio=the predetermined value Hk=1 is established, that is, in the normal area, the gradation value after correction is 128 (see the third correction quantity table in FIG. 19).

Further, in a case where a gradation value of pixel data is 120, and the usage rate of the second nozzle row (the second head 42B) is 100%, that is, in the lower end area, the gradation value after correction is 150 (see the second correction quantity table in FIG. 18).

Further, in a case where the gradation value of pixel data is 120, and in the transition area from the upper end area to the normal area, the usage rate of the first nozzle row (the first head 42A) is, for example, 75% (in the case of a relative usage ratio=3), the contribution rate of the first correction quantity table is 50% and the contribution rate of the third correction quantity table is 50%. Therefore, the gradation value after correction is 114 (=100×0.5+128×0.5).

Further, in a case where the gradation value of pixel data is 120, and in the transition area from the upper end area to the normal area, the usage rate of the first nozzle row (the first head 42A) is, for example, 60% (in the case of a relative usage ratio=1.5), the contribution rate of the first correction quantity table is 20% and the contribution rate of the third correction quantity table is 80%. Therefore, the gradation value after correction is 122.4 (=100×0.2+128×0.8).

Further, in a case where the gradation value of pixel data is 120, and in the transition area from the normal area to the lower end area, the usage rate of the first nozzle row (the first head 42A) is, for example, 25% (in the case of a relative usage ratio=0.33), the contribution rate of the third correction quantity table is 50% and the contribution rate of the second correction quantity table is 50%. Therefore, the gradation value after correction is 139 (=128×0.5+150×0.5).

Further, in a case where the gradation value of pixel data is 120, and in the transition area from the normal area to the lower end area, the usage rate of the first nozzle row (the first head 42A) is, for example, 20% (in the case of a relative usage ratio=0.25), the contribution rate of the third correction quantity table is 40% and the contribution rate of the second correction quantity table is 60%. Therefore, the gradation value after correction is 141.2 (=128×0.4+150×0.6).

As such, the printer driver uses a gradation value (for example, 120) of pixel data as an input gradation value to thereby obtain the gradation values after correction (for example, 100 (the upper end area), 114 (the middle portion of the transition area), 128 (the normal area), 139 (the middle of the transition area), and 150 (the lower end area)) in the upper end area, the transition area, the normal area, the transition area and the lower end area, respectively, according to the correction quantity tables available for reference and the contribution rates thereof.

If the gradation values of the entire pixel data of the raster data are corrected, the printer driver finishes the correction processing of color irregularity.

As described above, in the liquid droplet discharging method and the liquid droplet discharging apparatus according to the embodiments, it is possible to attain the following effects.

A liquid droplet discharging method according to the embodiment includes a transport action where the paper 10 is moved in the transporting direction, and a liquid droplet discharging action where the first nozzle row (the first head 42A) and the second nozzle row (the second head 42B) in which a plurality of nozzles is lined up in the transporting direction are caused to be scan-moved in the scanning direction intersecting the transporting direction and the liquid droplet is caused to be discharged to the paper 10 from the nozzle. Further, in the liquid droplet discharging method according to the embodiment, the transport action and the liquid droplet discharging action are alternately repeated so as to cause a plurality of dot rows, which is configured to include dots lined up in the scanning direction, to be formed in the transporting direction.

According to the embodiment, based on the first correction quantity table correlating to discharging of the first nozzle row (the first head 42A), the second correction quantity table correlating to discharging of the second nozzle row (the second head 42B), a relative usage ratio of the first nozzle row (the first head 42A) to the second nozzle row (the second head 42B) (=a usage rate of the first nozzle row (the first head 42A)/a usage rate of the second nozzle row (the second head 42B)), and a third correction quantity table correlating to discharging of a predetermined value Hk which is the relative usage ratio, a liquid droplet quantity, per a unit area in print media, discharged from the first nozzle row (the first head 42A) and/or the second nozzle row (the second head 42B) is corrected.

The first correction quantity table corresponds to a correction quantity table in which a liquid droplet quantity, per a unit area in print media, discharged from the nozzle of the first nozzle row (the first head 42A) is obtained according to a test pattern which is configured to include dot rows formed by discharging of the first nozzle row (the first head 42A) and the obtained liquid droplet quantity is corrected. In other words, if based on the first correction quantity table, it is possible to correct discharging of the liquid droplet from the nozzle of the first nozzle row (the first head 42A) according to liquid droplet discharging characteristics of the nozzle of the first nozzle row (the first head 42A).

The second correction quantity table corresponds to a correction quantity table in which a liquid droplet quantity, per a unit area in print media, discharged from the nozzle of the second nozzle row (the second head 42B) is obtained according to a test pattern which is configured to include dot rows formed by discharging of the second nozzle row (the second head 42B) and the obtained liquid droplet quantity is corrected. In other words, if based on the second correction quantity table, it is possible to correct discharging of the liquid droplet from the nozzle of the second nozzle row (the second head 42B) according to liquid droplet discharging characteristics of the nozzle of the second nozzle row (the second head 42B).

The third correction quantity table corresponds to a correction quantity table in which a liquid droplet quantity, per a unit area in print media, discharged from the nozzles of the first nozzle row (the first head 42A) and the second nozzle row (the second head 42B) is obtained according to a test pattern which is configured to include dot rows formed by discharging of the predetermined value Hk which is the relative usage ratio of the first nozzle row (the first head 42A) to the second nozzle row (the second head 42B), and the obtained liquid droplet quantity is corrected. In other words, if based on the third correction quantity table, it is possible to correct discharging of the liquid droplet from the nozzles of the first nozzle row (the first head 42A) and/or the second nozzle row (the second head 42B) according to liquid droplet discharging characteristics of the nozzle of the first nozzle row (the first head 42A) and liquid droplet discharging characteristics of the nozzle of the second nozzle row (the second head 42B), the liquid droplet discharging characteristics including relative positional shifts of dots between dots formed by the first nozzle row (the first head 42A) and dots formed by the second nozzle row (the second head 42B).

According to the liquid droplet discharging method of the embodiment, based on the first correction quantity table, the second correction quantity table, the third correction quantity table, and the relative usage ratio of the first nozzle row (the first head 42A) to the second nozzle row (the second head 42B), the liquid droplet quantity, per a unit area in print media, discharged from the first nozzle row (the first head 42A) and/or the second nozzle row (the second head 42B), that is, the liquid droplet quantity discharged to the print media in order to form the dot row is corrected. Therefore, according to the embodiment, it is possible to appropriately and respectively correct an area which is configured to include dot rows formed by discharging of the first nozzle row (the first head 42A), an area which is configured to include dot rows formed by discharging of the second nozzle row (the second head 42B), and an area which is configured to include dot rows formed by discharging of the first nozzle row (the first head 42A) and the second nozzle row (the second head 42B), and occurrence of difference between each area is suppressed when each area is corrected. Therefore, it is possible to perform more excellent printing.

Further, according to the embodiment, the predetermined value Hk is 1. In other words, since the usage rate of the first nozzle row (the first head 42A) and the usage rate of the second nozzle row (the second head 42B) are identical to each other, it is possible to more efficiently perform printing in the method in which the first nozzle row (the first head 42A) and the second nozzle row (the second head 42B) is used to perform printing.

Further, according to the embodiment, in a case where the relative usage ratio>the predetermined value Hk is established, that is, in a case where the usage rate of the first nozzle row (the first head 42A) is greater than the usage rate of the second nozzle row (the second head 42B), based on the first correction quantity table, the third correction quantity table, and the relative usage ratio, the liquid droplet quantity, per a unit area in print media, discharged from the first nozzle row (the first head 42A) and/or the second nozzle row (the second head 42B) is corrected. Further, in a case where the relative usage ratio<the predetermined value Hk, that is, in a case where the usage rate of the second nozzle row (the second head 42B) is greater than the usage rate of the first nozzle row (the first head 42A), based on the second correction quantity table, the third correction quantity table and the relative usage ratio, the liquid droplet quantity, per a unit area in print media, discharged from the first nozzle row (the first head 42A) and/or the second nozzle row (the second head 42B) is corrected. Since the correction is performed according to the correction quantity table correlating to the nozzle row having greater influence, it is possible to more appropriately perform the correction.

Further, according to the embodiment, the ink jet printer 100 includes a transport unit 20 that moves the paper 10 in a transporting direction, the first nozzle row (the first head 42A) and the second nozzle row (the second head 42B) in which a plurality of nozzles discharging the liquid droplet to the paper 10 is lined up in the transporting direction, the carriage unit 30 that causes the first nozzle row (the first head 42A) and the second nozzle row (the second head 42B) to be scan-moved in a scanning direction intersecting the transporting direction, and a controller 60 that performs drive-controlling of the transport unit 20 and the carriage unit 30 and performs discharge-control of the liquid droplet discharged from the nozzle so as to cause a plurality of dot rows, which is configured to include dots lined up in the scanning direction, to be formed in the transporting direction. Further, based on the first correction quantity table correlating to discharging of the first nozzle row (the first head 42A), the second correction quantity table correlating to discharging of the second nozzle row (the second head 42B), a relative usage ratio of the first nozzle row (the first head 42A) to the second nozzle row (the second head 42B) (=a usage rate of the first nozzle row (the first head 42A)/a usage rate of the second nozzle row (the second head 42B)), and a third correction quantity table correlating to discharging of a predetermined value Hk which is the relative usage ratio, a liquid droplet quantity, per a unit area in print media, discharged from the first nozzle row (the first head 42A) and/or the second nozzle row (the second head 42B) is corrected.

Therefore, according to the ink jet printer 100, it is possible to appropriately and respectively correct an area which is configured to include dot rows formed by discharging of the first nozzle row (the first head 42A), an area which is configured to include dot rows formed by discharging of the second nozzle row (the second head 42B), and an area which is configured to include dot rows formed by discharging of the first nozzle row (the first head 42A) and the second nozzle row (the second head 42B), and occurrence of a difference between each area is suppressed when each area is corrected. Therefore, it is possible to perform more excellent printing.

With Respect to an Appearance-Related Nozzle Arranging Direction

In one aspect of the invention, "the direction in which nozzles are arranged (line up)" is not limited to the direction in which the essentially and physically formed discharge outlets line up.

For example, regarding a diameter of openings of discharge outlets, in a case where discharge outlets adjacent to each other (existing in front and rear in a row of the discharge outlets) are arranged at short pitches, and the like, there may be a case where the nozzles are obliquely arranged. In a case where the nozzles are obliquely arranged, it is possible to provide a configuration in which the nozzles line up in the Y axis direction for appearance's sake according to a scheme in which timing for discharging ink is caused to be shifted with respect to the scanning speed of the carriage unit 30 in the X axis direction. For example, in scanning in the X axis direction, when a discharge outlet is disposed to be shifted by −d in position, a timing for discharging (=d/scanning speed) is caused to be delayed by td(=d/scanning speed) to thereby correct the shift of the discharge outlet.

Even in this case, in other words, even a case where the nozzles are not physically arranged in the Y axis direction, but are virtually arranged in the Y axis direction can be also regarded to be the same case as "the direction in which nozzles are arranged (lined up)" according to one aspect of the invention.

This application claims priority to Japanese Patent Application No. 2014-154608 filed on Jul. 30, 2014. The entire disclosure of Japanese Patent Application No. 2014-154608 is hereby incorporated herein by reference.

What is claimed is:

1. A liquid droplet discharging method, comprising:

providing a printer with a transport action where a print medium is moved in a transporting direction, and with a liquid droplet discharging scan action where a first print head and a second print head move and discharge liquid droplets onto the print medium in a scanning direction intersecting the transporting direction, said first print head having a first column of liquid-discharging nozzles lined up in the transporting direction, said second print head having a second column of liquid-discharging nozzles lined up in the transporting direction, said first print head and second print head being offset from each other in the scanning direction;

wherein:

said print medium has an upper-end portion wherein only the first print head discharges liquid onto the print medium, a central portion wherein both the first print head and second print head discharge liquid onto the print medium, and a lower-end portion wherein only the second print head discharges liquid onto the print medium;

said printer further having access to a first correction quantity table providing color correction based on liquid discharged only by the first print head, a second correction quantity table providing color correction based on an liquid discharge combination of both the first print head and second print head at a predetermined liquid discharge ratio Hk of the first print head to the second print head, and a third correction quantity table providing color correction based on liquid discharged only by the second print head;

the transport action and the liquid droplet discharging scan action are alternately repeated so as to cause a plurality of dot rows to be formed in the scanning direction during each liquid droplet discharge scan action, and for the print media to be advanced in the transporting direction a predefined number of dot rows during each transport action;

the method further comprising:

using the first correction quantity table, the second correction quantity table, the third correction quantity table, and a relative usage ratio defined as a ratio of expected liquid discharge of the first print head to expected liquid discharge of the second print head for a given liquid droplet discharging scan action to correct a liquid droplet quantity discharged from at least one of the first column of liquid-discharging nozzles and the second column of liquid-discharging nozzles in the given liquid droplet discharging scan action.

2. The liquid droplet discharging method according to claim 1, wherein the predetermined liquid discharge ratio Hk is 1, specifying that the liquid discharge of the first print head is substantially equal to the liquid discharge of the second print head value.

3. The liquid droplet discharging method according to claim 1, wherein in a case where the relative usage ratio>the predetermined value Hk is established, based on the first correction quantity table, the second correction quantity table and the relative usage ratio, the liquid droplet quantity, per a unit area in print media, discharged from the first nozzle row and/or the second nozzle row in order to form a row of printed dots is corrected, and wherein in a case where the relative usage ratio<the predetermined value Hk is established, based on the second correction quantity table, the third correction quantity table and the relative usage ratio, the liquid droplet quantity discharged from the first nozzle row and/or the second nozzle row is corrected.

4. The method of claim 1, wherein said first print head and second print head further have an overlapping portion wherein the first column of liquid-discharging nozzles partly overlaps the second column of liquid-discharging nozzles in the scanning direction.

5. The method of claim 1, further comprising:

using the first correction quantity table, and avoiding the use of the second correction quantity table and the third correction quantity table, to correct a liquid droplet quantity discharged from the first print head in in the upper-end portion of the print medium;

using the second correction quantity table, and avoiding the use of the first correction quantity table and the third correction quantity table, to correct liquid droplet quantities in the first print head and second print head in the central portion of the print medium; and using the third correction quantity table, and avoiding the use of the first correction quantity table and the second correction quantity table, to correct a liquid droplet quantity discharged from the second print head in in the lower-end portion of the print medium.

6. The method of claim 5, wherein:

in said central portion, both the first print head and second print head discharge liquid onto the printing medium in substantially equal portions;

said print medium further has an upper transition portion between the upper-end portion and the central portion;

both the first print head and second print head discharge liquid onto the printing medium within the upper transition portion in unequal portions; and said first correction quantity table, said second correction quantity table and said relative usage ratio are used, and the third correction quantity table is avoided, to correct the liquid droplet quantity discharged from both the first column of liquid-discharging nozzles and the second column of liquid-discharging nozzles within the upper transition portion in the given liquid droplet discharging scan action.

7. The method of claim 6, wherein:

prior to correcting the liquid droplet quantity discharged from both the first and second columns of liquid-discharging nozzles, the first and second columns of liquid-discharging nozzles have an initially assigned image gradation value common to them both; and the liquid droplet quantity discharged from the first column of liquid-discharging nozzles and the second column of liquid-discharging nozzles is corrected by assigning to them a new image gradation value in common to them both.

8. The method of claim 5, wherein:

in said central portion, both the first print head and second print head discharge liquid onto the printing medium in substantially equal portions;

said print medium further has a lower transition portion between the central portion and the lower-end portion;

both the first print head and second print head discharge liquid onto the printing medium within the lower transition portion in unequal portions; and said second correction quantity table, said third correction quantity table and said relative usage ratio are used, and the use of the first correction quantity table is avoided, to correct the liquid droplet quantity discharged from both the first column of liquid-discharging nozzles and the second column of liquid-discharging nozzles within the lower transition portion in the given liquid droplet discharging scan action.

9. The method of claim 1, wherein:

said second correction quantity table is created by printing a predefined pattern within a central portion of a calibration print medium using both the first print head and the second print head, obtaining a color measure of the resultant print, and determining a corrective quantity from a comparison of the color measure with a predefined goal measure; and said predefined pattern is created by said first column of liquid-discharging nozzles printing its individual liquid dots in a first zigzag lattice pattern and said second column of liquid-discharging nozzles printing its individual liquid dots in said second zigzag lattice pattern arranged to overlap and fill unprinted spaces within the first zigzag lattice pattern.

10. The method of claim 1, wherein:

the liquid discharged by all the nozzles in said first column of liquid-discharging nozzles is of a single color common to all the nozzles in the first column of liquid-discharging nozzles; and the liquid discharged by all the nozzles in said second column of liquid-discharging nozzles is of the same single color common to all the nozzles in the first column of liquid-discharging nozzles.

11. A liquid droplet discharging apparatus comprising:

a transport mechanism that moves a print medium in a transporting direction;

first print head and a second print head that, in a liquid droplet discharging scan action, move and discharge liquid droplets onto the print medium in a scanning direction that intersects the transporting direction, said first print head having a first column of liquid-discharging nozzles lined up in the transporting direction, said second print head having a second column of liquid-discharging nozzles lined up in the transporting direction, said first print head and second print head being offset from each other in the scanning direction;

a scan mechanism that moves first print head and the second print head in the scanning direction in the liquid droplet discharging scan action; and a controller that controls the transport mechanism, the scan mechanism, and discharge of liquid droplets discharged from the first and second columns of liquid-discharging nozzles; and a first correction quantity table providing color correction based on liquid discharged only by the first print head, a second correction quantity table providing color correction based on an a liquid discharge combination of both the first print head and second print head at a constant, predetermined liquid discharge ratio Hk of the first print head to the second print head, and a third correction quantity table providing color correction based on liquid discharged only by the second print head;

wherein:

said print medium has an upper-end portion wherein only the first print head discharges liquid onto the print medium, a central portion wherein both the first print head and second print head discharge liquid onto the printing medium, and a lower-end portion wherein only the second print head discharges liquid onto the print medium; and the first correction quantity table, the second correction quantity table, the third correction quantity table, and a relative usage ratio defined as a ratio of expected liquid discharge of the first print head to expected liquid discharge of the second print head for a given liquid droplet discharging scan action are used to correct a liquid droplet quantity discharged from at least one of the first column of liquid-discharging nozzles and the second column of liquid-discharging nozzles in the given liquid droplet discharging scan action.

12. The liquid droplet discharging apparatus of claim 11, wherein the predetermined liquid discharge ratio Hk specifies that the liquid discharge of the first print head is substantially equal to the liquid discharge of the second print head value.

13. The liquid droplet discharging apparatus of claim 11, wherein said first print head and second print head further have an overlapping portion wherein the first column of liquid-discharging nozzles partly overlaps the second column of liquid-discharging nozzles in the scanning direction.

14. The liquid droplet discharging apparatus of claim 11, wherein:

the first correction quantity table is used, and the second correction quantity table and the third correction quantity table are avoided, to correct a liquid droplet quantity discharged from the first print head in in the upper-end portion of the print medium;

the second correction quantity table is used, and the first correction quantity table and the third correction quantity table are avoided, to correct liquid droplet quantities in the first print head and second print head in the central portion of the print medium; and the third correction quantity table is used, and the first correction quantity table and the second correction quantity table are avoided, to correct a liquid droplet quantity discharged from the second print head in in the lower-end portion of the print medium.

15. The liquid droplet discharging apparatus of claim 14, wherein:

in said central portion, both the first print head and second print head discharge liquid onto the printing medium in substantially equal portions;

said print medium further has an upper transition portion between the upper-end portion and the central portion;

both the first print head and second print head discharge liquid onto the printing medium within the upper transition portion in unequal portions; and said first correction quantity table, said second correction quantity table and said relative usage ratio are used, and the second correction quantity table is avoided, to correct the liquid droplet quantity discharged from both the first column of liquid-discharging nozzles and the second column of liquid-discharging nozzles within the upper transition portion in the given liquid droplet discharging scan action.

16. The liquid droplet discharging apparatus of claim 15, wherein:

prior to correcting the liquid droplet quantity discharged from both the first and second columns of liquid-discharging nozzles, the first and second columns of liquid-discharging nozzles have an initially assigned image gradation value common to them both; and the liquid droplet quantity discharged from the first column of liquid-discharging nozzles and the second column of liquid-discharging nozzles is corrected by assigning to them a new image gradation value in common to them both.

17. The liquid droplet discharging apparatus of claim 15, wherein:

said print medium further has a lower transition portion between the central portion and the lower-end portion;

both the first print head and second print head discharge liquid onto the printing medium within the lower transition portion in unequal portions; and said second correction quantity table, said third correction quantity table and said relative usage ratio are used, and the first correction quantity table is avoided, to correct the liquid droplet quantity discharged from both the first column of liquid-discharging nozzles and the second column of liquid-discharging nozzles within the lower transition portion in the given liquid droplet discharging scan action.

18. The liquid droplet discharging apparatus of claim 14, wherein:

in said central portion, both the first print head and second print head discharge liquid onto the printing medium in substantially equal portions;

said print medium further has a lower transition portion between the central portion and the lower-end portion;

both the first print head and second print head discharge liquid onto the printing medium within the lower transition portion in unequal portions; and said second correction quantity table, said third correction quantity table and said relative usage ratio are used, and the first correction quantity table is avoided, to correct the liquid droplet quantity discharged from both the first column of liquid-discharging nozzles and the second column of liquid-discharging nozzles within the lower transition portion in the given liquid droplet discharging scan action.

19. The liquid droplet discharging apparatus of claim 11, wherein:

said second correction quantity table is created by printing a predefined pattern within a central portion of a calibration print medium using both the first print head and the second print head, obtaining a color measure of the resultant print, and determining a corrective quantity from a comparison of the color measure with a predefined goal measure; and said predefined pattern is created by said first column of liquid-discharging nozzles printing its individual liquid dots in a first zigzag lattice pattern and said second column of liquid-discharging nozzles printing its individual liquid dots in said second zigzag lattice pattern arranged to overlap and fill unprinted spaces within the first zigzag lattice pattern.

20. The liquid droplet discharging apparatus of claim 11, wherein:

the liquid discharged by all the nozzles in said first column of liquid-discharging nozzles is of a single color common to all the nozzles in the first column of liquid-discharging nozzles; and the liquid discharged by all the nozzles in said second column of liquid-discharging nozzles is of the same single color common to all the nozzles in the first column of liquid-discharging nozzles.

* * * * *